US012163288B2

(12) United States Patent
Pelton et al.

(10) Patent No.: US 12,163,288 B2
(45) Date of Patent: Dec. 10, 2024

(54) TREATED SUBSTRATES AND METHODS OF PRODUCING THE SAME

(71) Applicant: SOLENIS TECHNOLOGIES, L.P., Wilmington, DE (US)

(72) Inventors: Robert Pelton, Hamilton (CA); Hongfeng Zhang, Hamilton (CA)

(73) Assignee: Solenis Technologies, L.P., Wilmington, DE (US)

( * ) Notice: Subject to any disclaimer, the term of this patent is extended or adjusted under 35 U.S.C. 154(b) by 149 days.

(21) Appl. No.: 17/647,861

(22) Filed: Jan. 13, 2022

(65) Prior Publication Data

US 2022/0228320 A1 Jul. 21, 2022

Related U.S. Application Data

(60) Provisional application No. 63/138,882, filed on Jan. 19, 2021.

(51) Int. Cl.

| | |
|---|---|
| ***D21H 19/20*** | (2006.01) |
| ***D21H 11/04*** | (2006.01) |
| ***D21H 23/04*** | (2006.01) |

(52) U.S. Cl.

CPC ..... *D21H 19/20* (2013.01); *D21H 11/04* (2013.01); *D21H 23/04* (2013.01)

(58) Field of Classification Search

CPC ..... D21H 19/20; D21H 11/04; D21H 23/04; D21H 11/20; D21H 17/16

See application file for complete search history.

(56) References Cited

U.S. PATENT DOCUMENTS

| | | | | |
|---|---|---|---|---|
| 142,596 | A | 9/1873 | Tunison et al. | |
| 3,855,299 | A * | 12/1974 | Witt | C07C 215/14 210/708 |
| 4,210,489 | A * | 7/1980 | Markofsky | D21H 17/54 162/164.3 |
| 4,391,878 | A | 7/1983 | Drach | |
| 5,190,563 | A | 3/1993 | Herron et al. | |
| 5,549,791 | A | 8/1996 | Herron et al. | |
| 5,755,828 | A | 5/1998 | Westland | |
| 5,998,511 | A | 12/1999 | Westland et al. | |
| 6,184,271 | B1 | 2/2001 | Westland et al. | |

(Continued)

FOREIGN PATENT DOCUMENTS

| | | | | |
|---|---|---|---|---|
| CN | 102597009 B | * | 6/2016 | A61P 17/00 |
| CN | 109072551 A | * | 12/2018 | B32B 29/06 |

(Continued)

OTHER PUBLICATIONS

ISA/US, International Search Report and Written Opinion issued in Int. Appl. No. PCT/US2022/070216 mailed May 3, 2022.

(Continued)

*Primary Examiner* — Jose A Fortuna

(74) *Attorney, Agent, or Firm* — Lorenz & Kopf, LLP

(57) ABSTRACT

Treated substrates and methods of forming the same are provided. In an exemplary embodiment, a treated substrate includes lignocellulose and a polymer fixed to the lignocellulose to form the treated substrate. The polymer includes a succinic moiety that can reversibly change between a succinic anhydride and a succinic acid moiety. The treated substrate has a wet tensile index of about 3 newton meters per gram or less.

18 Claims, 11 Drawing Sheets

(56) References Cited

U.S. PATENT DOCUMENTS

| | | | | |
|---|---|---|---|---|
| 6,471,824 | B1 | 10/2002 | Jewell | |
| 6,579,414 | B2 | 6/2003 | Jewell | |
| 6,579,415 | B2 | 6/2003 | Jewell | |
| 6,592,717 | B2 | 7/2003 | Jewell | |
| 6,852,197 | B2 * | 2/2005 | Wallenius | C08G 73/0213 162/158 |
| 7,435,266 | B2 * | 10/2008 | Sun | D06M 15/285 8/554 |
| 8,118,976 | B2 * | 2/2012 | Johansson-Vestin | D21H 21/20 162/158 |
| 9,133,578 | B2 * | 9/2015 | Ruda | C11D 3/3769 |
| 2003/0131962 | A1 | 7/2003 | Lindsay et al. | |
| 2004/0118540 | A1 * | 6/2004 | Garnier | D21H 17/37 162/168.3 |
| 2005/0048207 | A1 | 3/2005 | Gutowski et al. | |
| 2006/0065380 | A1 * | 3/2006 | Garnier | D21H 17/37 162/168.3 |
| 2011/0060148 | A1 | 3/2011 | O'Connor et al. | |
| 2011/0190423 | A1 | 8/2011 | Varnell et al. | |
| 2012/0058536 | A1 * | 3/2012 | Ruda | C11D 3/227 525/54.23 |
| 2012/0183723 | A1 | 7/2012 | Srinivasan et al. | |
| 2022/0228320 | A1 * | 7/2022 | Pelton | D21H 11/04 |
| 2022/0275201 | A1 * | 9/2022 | Dong | C08L 67/02 |
| 2024/0093023 | A1 * | 3/2024 | Zarrinbakhsh | C08L 67/04 |

FOREIGN PATENT DOCUMENTS

| | | | | |
|---|---|---|---|---|
| EP | 1242466 | B1 * | 1/2004 | C08F 21/18 |
| EP | 1456472 | B2 * | 5/2012 | D21H 21/18 |
| EP | 2435485 | B1 * | 1/2019 | A61P 17/00 |
| KR | 20230133333 | A * | 9/2023 | D21H 17/16 |
| WO | WO-2022159931 | A1 * | 7/2022 | D21H 11/04 |

OTHER PUBLICATIONS

Wagberg et al., "On the Charge Stoichiometry upon Adsorption of a Cationic Polyelectrolyte on Cellulosic Materials", Colloids and Surfaces, 27 (1987), 163-173; Elsevier Science Publishers B.V.

Wagberg et al., "Physicochemical characterization of papermaking fibres", The Fundamentals of Papermaking Materials, Trans. of the XIth Fund. Res. Symp. Cambridge, 1997, pp. 1-82, FRC, Manchester.

Wagberg et al., "On the mechanism behind wet strength development in papers containing wet strength resins", SCA Research AB, 1992.

Wagberg et al., "Charge determination of porous substrates by polyelectrolyte adsorption", Nordic Pulp and Paper Research Journal No. Feb. 1989.

Xu et al., "Comparison of the Kraft Paper Crosslinked by Polymeric Carboxylic Acids of Large and Small Molecular Sizes: Dry and Wet Performance", Comparison of Crosslinked Kraft Paper, 1999.

Xu et al., "Application of polymeric multifunctional carboxlic acids to improve wet strength", Peer Reviewed, vol. 81, No. 11, Tappi Journal, Nov. 1998.

Xu et al., "Wet reinforcement of paper with high-molecular-weight multifunctional carboxylic acid", Wet Strength, Tappi Journal, Aug. 1999.

Xu et al., "Effects of Poly(vinyl Alcohol) on the Strength of Kraft Paper Crosslinked by a Polyarboxylic Acid", Journal of Pulp and Paper Science, vol. 27, No. 1, Jan. 2001.

Yang, C. Q. Infrared Spectroscopy Studies of the Cyclic Anhydride as the Intermediate for the Ester Crosslinking of Cotton Cellulose by Polycarboxylic Acids. I. Identification of the Cyclic Anhydride Intermediate. J. Polym. Sci., Part A: Polym. Chem. 1993, 31, 1187-1193.

Yang et al., "Formation of Cyclic Anhydride Intermediates and Esterification of Cotton Cellulose by Multifunctional Carboxylic Acids: An Infrared Spectroscopy Study", Textile Res. J. 66(9), 595-603 (Sep. 1996).

Yang et al., "FT-IR Spectroscopy Study of the Polycarboxylic Acids Used for Paper Wet Strength Improvement", Ind. Eng. Chem. Res., 1996, 35, 4037-4042.

Yang et al., "Infrared Spectroscopy Studies of the Cyclic Anhydride as the Intermediate for the Ester Crosslinking of Cotton Cellulose by Polycarboxylic Acids. II. Comparison of Different Polycarboxylic Acids", Journal of Polymer Science: Part A: Polymer Chemistry, vol. 34, 1573-1580 (1996).

Yang et al., "Paper Wet Performance and Ester Crosslinking of Wood Pulp Cellulose by Poly(carboxylic acid)s", ournal of Polymer Sciencea, vol. 67, 649-658 (1998).

Yang et al., "Wet-peel: a tool for comparing wet-strength resins", Nordic Pulp & Paper Research Journal 2018, 33(4):632-646.

Yang et al., "Increasing wet adhesion between cellulose surfaces with polyvinylamine", Cellulose, ISSN 0969-0239, vol. 26, No. 1 (2019).

B. Alince and T.G.M. van de Ven. Porosity of swollen pulp fi bers evaluated by polymer adsorption. In The Fundametals of Papermaking Materials, Trans. of the XIth Fund. Res. Symp. Cambridge, 1997, (C.F. Baker, ed.), pp. 771-788, FRC, Manchester, 2018. DOI: 10.15376/frc.1997.2.771.

B. Alince, "Porosity of swollen pulp fibers revisited", Pulp and Paper Research Centre, McGill University, 2001.

Ankerfors et al., "Topo-chemical modifications of fibres by grafting of carboxymethyl cellulose in pilot scale", 8th International Paper and Coating Chemistry Symposium 2012, Nordic Pulp and Paper Research Journal, vol. 28, No. Jan. 2013.

Barzyk et al., "Acidic Group Topochemistry and Fibre-to-Fibre Specific Bond Strength", Journal of Pulp and Paper Science, vol. 23, No. 2, Feb. 2, 1997.

Mohamed Naceur Belgacem & Alessandro Gandini (2005) The surface modification of cellulose fibres for use as reinforcing elements in composite materials, Composite Interfaces, 12:1-2, 41-75, DOI: 10.1163/1568554053542188.

Bianchi et al., "Ethylene-Maleic Anhydride Copolymers and Derivatives. Potentiometrie Titrations and Interactions with Polypeptides", Chemistry Department, University of Genoa, Jun. 20, 1969.

Chen et al., Aqueous Polymerization of Maleic Acid and Cross-Linking of Cotton Cellulose by Poly(maleic acid), Department of Textiles, Merchandising and Interiors, University of Georgia, Ind. Eng. Chem. Res. 2005, 44, 7921-7927.

Chung et al., "Glass Transition Temperatures of Poly(methyl Vinyl Ether-co-Maleic Anhydride) (PMVEMA) and Poly (methyl Vinyl Ether-co-Maleic Acid) (PMVEMAC) and the Kinetics of Dehydration of PMVEMAC by Thermal Analysis", GAF Chemicals Corp., 1989.

Cooper et al., "Effects of molecular weight and plasticization on dissolution rates of thin polymer films", School of Chemical Engineering, Cornell University, Butterworth & Co. Ltd., Polymer, vol. 26., 1985.

Dubin et al., "Hydrophobic Bonding in Alternating Copolymers of Maleic Acid and Alkyl Vinyl Ethers", The Journal of Physical Chemistry, vol. 74, No. 14, 1970.

Duker et al., "The use of CMC as a dry strength agent—the interplay between CMC attachment and drying", Nordic Pulp and Paper Research Journal, vol. 23, No. Jan. 2008.

Duker et al., "On the mechanism behind the ability of CMC to enhance paper strength", Nordic Pulp and Paper Research Journal, vol. 23, No. Jan. 2008.

Eisenberg et al., "Dehydration Kinetics and Glass Transition of Poly(acrylic Acid)", Journal of Polymer Science: Part A-1, vol. 7, 1717-1728, 1969.

Evenson et al., "Solventless Attachment of Long-Chain Molecules to Poly(ethylene-alt-maleic anhydride) Copolymer Surfaces", J. Phys. Chem. B 1998, 102, 5500-55002.

Evenson et al., "Surface Esterification of Poly(Ethylene-alt-Maleic Anhydride) Copolymer", J. Phys. Chem. B 2000, 104, 10608-10611.

Forsstrom et al., "Influence of fibre/fibre joint strength and fibre flexibility on the strength of papers from unbleached kraft fibres", Nordic Pulp and Paper Research Journal vol. 20 No. Feb. 2005.

(56) References Cited

OTHER PUBLICATIONS

Fras et al., "Analysis of the oxidation of cellulose fibres by titration and XPS", Colloids and Surfaces: A Physicochem. Eng. Aspects 260 (2005) 101-1080.
Freudenberg et al., "Covalent Immobilization of Cellulose Layers onto Maleic Anhydride Copolymer Thin Films", Biomacromolecules 2005, 6, 1628-1634.
Garnier et al., "Association in Solution and Adsorption at an Air-Water Interface of Alternating Copolymers of Maleic-Anhydride and Styrene", Langmuir 2000, 16, 3757-3763.
Greenberg et aql., "Kinetics of Anhydride Formation in Poly(acrylic Acid) and Its Effect on the Properties of a PAA-Alumina Composite", Journal of Polymer Science: Polymer Chemistry Edition, vol. 15, 2137-2149 (1977).
Gu et al., "Ft-Ir and Ft-Raman Spectroscopy Study of the Cyclic Anhydride Intermediates for Esterification of Cellulose: I. Formation of Anhydrides Without a Catalyst", Res. Chem. Intermed., vol. 24, No. 9, pp. 979-996 (1998).
Higuchi et al., "Faciliated Reversible Formation of Amides from Carboxylic Acids in Aqueous Solutions. Intermediate Production of Acid Anhydride", Amides from Aqueous Carboxylic Acids, Nov. 20, 1963.
Isogai et al., "Preparation of polyuronic acid from cellulose by TEMPO-mediated oxidation", Cellulose (1998), 5, 153-164.
Johnson, David, Ward, "New Applications for Poly(ethylene-alt-maleic anhydride)", Durham theses, Durham University, 2010, http://etheses.dur.ac.uk/886/.
Katz et al., "The determination of strong and weak acidic groups in sulfite pulps", Pulp and Paper Research Institute of Canada, 1984.
Khutoryanskaya et al., "Characterisation of Blends Based on Hydroxyethylcellulose and Maleic Acid-alt-Methyl Vinyl Ether", Macromolecular Chemistry and Physics, 2005, 206, 1497-1510; DOI 10.1002/macp.200500069.
Kitaoka et al., "Chemical modification of pulp fibers by TEMPO-mediated oxidation", Nordic Pulp and Paper Research Journal vol. 14 No. Apr. 1999.
Laine et al., "Studies on topochemical modification of cellulosic fibres", Nordic Pulp and Paper Research Journal vol. 15 No. May 2000.
Laine et al., "Studies on topochemical modification of cellulosic fibres", Nordic Pulp and Paper Research Journal vol. 17 No. Jan. 2002.
Laine et al., "Studies on topochemical modification of cellulosic fibres", Nordic Pulp and Paper Research Journal vol. 18 No. 31/2003.
Lee et al., "Prediction of Polymer Dissolution in Swellable Controlled-Release Systems", Journal of Controlled Release, 6 (1987) 207-215, Elsevier Science Publishers B.V.
Lee et al., "Grafting of Maleic Anhydride Copolymers onto Cellulose Acetate and Methyl Cellulose", Journal of Wood Chemistry and Technology, 12:2, 231-240, DOI: 10.1080/02773819208545081.
Lepoutre et al., "The Water Absorbency of Hydrolyzed Polyacrylonitrile-Grafted Cellulose Fibers", Journal of Applied Polymer Science, vol. 17, pp. 3143-3156 (1973).
Lindstrom et al., "The effect of carboxyl groups and their ionic form during drying on the hornification of cellulose fibers", Swedish Forest Products Research Laboratory, pp. 146-151 (1982).
Lindström et al., "The effect of chemical environment on fiber swelling", Swedish Forest Products Research Laboratory, pp. 14-20 (1980).
Miller-Chou et al., "A review of polymer dissolution", Prog. Polym. Sci. 28 (2003), 1223-1270.
Musa, "Handbook of Maleic Anhydride Based Materials", Springer, 2016, ISBN 978-3-319-29453-7; DOI 10.1007/978-3-319-29454-4.
Page, "A Theory for the Tensile Strength of Paper", Paper Physics; Tappi Journal Reprint; Oct. 2018, vol. 17 No. 18.
Pelton et al., "The influence of dextran molecular weight on the dry strength of dextran-impregnated paper", Peer-Reviewed Paper Strength; vol. 2, No. 4; Tappi Journal; Apr. 2003.
Pompe et al., "Maleic Anhydride Copolymers—A Versatile Platform for Molecular Biosurface Engineering", Biomacromolecules 2003, 4, 1072-1079.
Rätzsch, "Alternating Maleic Anhydride Copolymers", Prog. Polym. Sci., vol. 13, 277-337, 1988.
Saito et al., "Ion-exchange behavior of carboxylate groups in fibrous cellulose oxidized by the TEMPO-mediated system", Elsevier, Carbohydrate Polymers 61 (2005) 183-190.
Saito et al., "Wet Strength Improvement of TEMPO-Oxidized Cellulose Sheets Prepared with Cationic Polymers", Ind. Eng. Chem. Res. 2007, 46, 773-780.
Sjostrom et al., "The Acidic Groups in Wood and Pulp as Measured by Ion Exchange", Journal of Polymer Science: Part C, No. 11, pp. 221-241 (1965).
Stone et al., "A Structural Model for the Cell Wall of Water-Swollen Wood Pulp Fibres Based on Their Accessibility to Macromolecules", Pulp and Paper Research Institute of Canada, Cellulose Chemistry and Technology, 2, 343-358 (1968).
Switala Zeliazkow, "Thermal degradation of copolymers of styrene with dicarboxylic acids I. Alternating styrene-maleic acid copolymer", Elsevier, Polymer Degradation and Stability 74 (2001) 579-584.
Jeberreiter et al., "Velocity of Dissolution of Polystyrene", Journal of Polymer Science, vol. XXIII, pp. 75-81 (1957).
Uhlmann et al., "Characterization of Maleic Acid/Anhydride Copolymer Films by Low-Rate Dynamic Liquid-Fluid Contact Angle Measurements Using Axisymmetric Drop Shape Analysis", Langmuir 2005, 21, 6302-6307.
Vitta et al., "The Preparation and Properties of Acrylic and Methacrylic Acid Grafted Cellulose Prepared by Ceric Ion Initiation. Part I. Preparation of the Grafted Cellulose", Journal of Macromolecular Science: Part A—Chemistry, 22:5-7, 579-590 (1985), DOI: 1.1080/00222338508056624.

* cited by examiner

TREATED SUBSTRATES AND METHODS OF PRODUCING THE SAME

PRIORITY CLAIM

This application claims priority to U.S. Provisional Patent Application Ser. No. 63/138,882 filed on Jan. 19, 2021, which is incorporated herein by reference.

TECHNICAL FIELD

This description relates to treated substrates and methods of producing the same, and more particularly relates to lignocellulose substrates used in the pulp and paper industry that are treated with polymeric compounds.

BACKGROUND

Since the earliest days of the modern pulp and paper industry, efforts have been made to expand the property space of wood pulp fibers by attaching ionizable carboxylic acid groups to exposed fiber surfaces. These efforts are inspired by the knowledge that the presence of ionized carboxyl groups promote increased cellulose fiber swelling and flexibility, decreased hornification, increased ion exchange capacity, and increased adsorption capacity and strength during papermaking. The resulting papers can be better absorbents, and stronger both wet and dry.

Pure cellulose, by definition, does not have carboxylic acid groups. By contrast, wood pulp fibers have some ionized groups (usually carboxyl groups) owing to the presence of hemicellulose and lignin. The total fiber charge content is usually expressed as equivalents of titratable groups per mass of dry fiber, expressed as a positive number although the charges in most cases are negative. The ionizable carboxylic acid groups are titratable, so they can be measured. Bleached kraft pulps have low charge contents of the order 0.01 milliequivalent per gram of dry fiber (meq/g). Unbleached and chemi-thermomechanical pulps (CTMP pulps) typically have an order of magnitude more titratable charge. The topochemical distribution of charges within pulp fibers is usually characterized by two values, the "total charge" and the "surface charge". The total charge can be measured by conductometric titration or by the adsorption of very low molecular weight cationic polymers. Surface charge is determined from the adsorption of high molecular weight cationic polymers that cannot access the small pores in the pulp fiber walls.

Two common ways to introduce carboxyl groups onto and into pulp fiber are: 1) oxidation to give carboxylic acid groups; and, 2) the covalent grafting of charged molecules. Cellulose carboxymethylation with monochloroacetic acid in isopropyl alcohol is a good example of covalent attachment of small, charged molecules that has been frequently described in the literature. Neither oxidation nor small molecule grafting are suitable for implementation in a conventional pulp mill because they involve potentially polluting and expensive low molecular weight organic solvents and/or reagents.

An alternative approach to increasing fiber surface charge is the attachment of charged polymers. Although it is possible to grow polymers from fiber surfaces, a process called "grafting from," this approach also involves small molecule organic chemistry and is not suitable for pulp mill application. Surface charge enhancement can give stronger fiber/fiber joints, increased ion-exchange capacities, increased water absorbency and increased functional groups for subsequent surface modification. In spite of these potential advantages, kraft market pulps with enhanced surface properties are not widely marketed because bleached cellulose fibers are barren, relatively unreactive surfaces that are difficult to chemically modify under the aqueous conditions in a pulp mill.

Surface modified pulp should be amendable to the papermaking process. Bales of dry market pulps should easily disperse into individualized fibers when added to water, a process called repulping in the paper industry. For treated pulps, polymer-enhanced fiber/fiber adhesion can impart high wet strength to dried pulp, preventing rapid repulping in a papermill. For example, maleic anhydride copolymers have been reported to impart high wet strength in both the patent (Jewell, R. A. Method of Increasing the Wet Strength of a Fibrous Sheet. Pat. U.S. Pat. No. 6,579,415 B2, Jun. 17, 2003) and the scientific literature (Xu, G. G.; Yang, C. Q.; Deng, Y. Effects of Poly(vinyl Alcohol) on the Strength of Kraft Paper Crosslinked by a Polycarboxylic Acid. J. Pulp Paper Sci. 2001, 27, 14-17; Yang, C. Q.; Xu, Y.; Wang, D. FT-IR Spectroscopy Study of the Polycarboxylic Acids Used for Paper Wet Strength Improvement. Ind. Eng. Chem. Res. 1996, 35, 4037-4042) This literature suggests such treatments lead to products that cannot be repulped easily. Pulp with a wet tensile index of about 3 newton meters per gram or more is difficult to repulp, where pulp with lower wet tensile indices are more amendable to rapid dispersion in pulpers before the papermaking process. The term "pulp" can refer to both a dried product and a wet suspension which does not have a wet tensile index. Pulp sheets, formed in a laboratory papermaking process, do have a wet tensile index.

Accordingly, treated substrates and methods of treating such substrates to produce lignocellulose with enhanced surface charges are desirable. In addition, the treated substrates should be amenable to the papermaking process with a wet tensile index of about 3 newton meters per gram or less. Furthermore, other desirable features and characteristics will become apparent from the subsequent detailed description and the appended claims, taken in conjunction with the accompanying drawing and this background.

BRIEF SUMMARY

Treated substrates and methods of forming the same are provided. In an exemplary embodiment, a treated substrate includes lignocellulose and a polymer fixed to the lignocellulose to form the treated substrate. The polymer includes a succinic moiety that can reversibly change between a succinic anhydride and a succinic acid moiety. The treated substrate has a wet tensile index of about 3 newton meters per gram or less.

In another embodiment a treated substrate comprises lignocellulose and a polymer fixed to the lignocellulose to form the treated substrate. The polymer includes poly(ethylene-co-maleic acid), and the treated substrate has a wet tensile index of about 3 newton meters per gram or less. The treated substrate has a fixed $\Gamma_f$ value that represents an amount of polymer fixed to the treated substrate measured in milliequivalents of a titratable carboxyl group of the polymer per gram of dry treated substrate. The fixed gamma value is about 0.001 milliequivalents per gram of dry treated substrate or greater.

In yet another embodiment, a method of forming a treated substrate is provided. The method includes applying a polymer ingredient to an untreated substrate to form a polymer substrate combination. The untreated substrate includes lignocellulose, and the polymer ingredient includes a polymer with a succinic moiety that can reversibly change between a succinic anhydride and a succinic acid moiety. The polymer is fixed to the untreated substrate to form the treated substrate by heating the polymer substrate combination to a curing temperature of about 100° C. or greater for a curing time. The heating of the polymer substrate combination is terminated when a wet tensile index of the treated substrate is about 3 newton meters per gram or less, and when a fixed gamma value of the treated substrate is about 0.001 milliequivalents per gram of dry treated substrate or greater. The fixed gamma value represents an amount of polymer fixed to the treated substrate measured in milliequivalents of titratable carboxyl groups of the polymer per gram of dry treated substrate.

BRIEF DESCRIPTION OF THE DRAWINGS

The present disclosure will hereinafter be described in conjunction with the following drawing figures, wherein like numerals denote like elements, and.

DETAILED DESCRIPTION

The following detailed description is merely exemplary in nature and is not intended to limit the application or uses of the embodiments described. Furthermore, there is no intention to be bound by any theory presented in the preceding technical field, background, brief summary, or the following detailed description.

A cellulosic untreated substrate is treated with a polymer having succinic moieties to provide surface carboxylic acid moieties, which may be charged. A polymer ingredient is applied to the untreated substrate, and the polymer is fixed to the lignocellulose by heat to produce a treated substrate. The treated substrate, with the fixed polymer, is at least partially dried during the curing process. The polymer is fixed to the lignocellulose, where the polymer may be covalently bonded with an ester bond or physically adhered to the lignocellulose such that the polymer remains with the lignocellulose in subsequent processing, and increases paper strength made from the treated substrate. However, the treated cellulosic substrate tends to have a high wet tensile index, which makes re-pulping of the dried treated substrate difficult. Not to be bound by theory, but it is speculated that the process conditions that fix the polymer to the treated substrate also serve to convert the succinic moieties from a succinic acid form to a succinic anhydride form, or to crosslink the fixed polymer to form a crosslinked network between fibers at points of fiber-fiber contact. It has been discovered that the polymer may be fixed to the lignocellulose while limiting the increase in the wet tensile index if the curing process is controlled, so extensive conversion of the succinic acid form to the succinic anhydride form is avoided. Many different equipment configurations may be utilized for fixing polymer to the substrate in various embodiments, so a measurable parameter has been determined to indicate the heating conditions in the curing process the provide a high fixation yield and a wet tensile index that is still at acceptably low values. This measurable parameter is a "beta gamma" product of the treated substrate ($\beta\Gamma_a$), defined more fully in the following disclosure.

Figure 1:
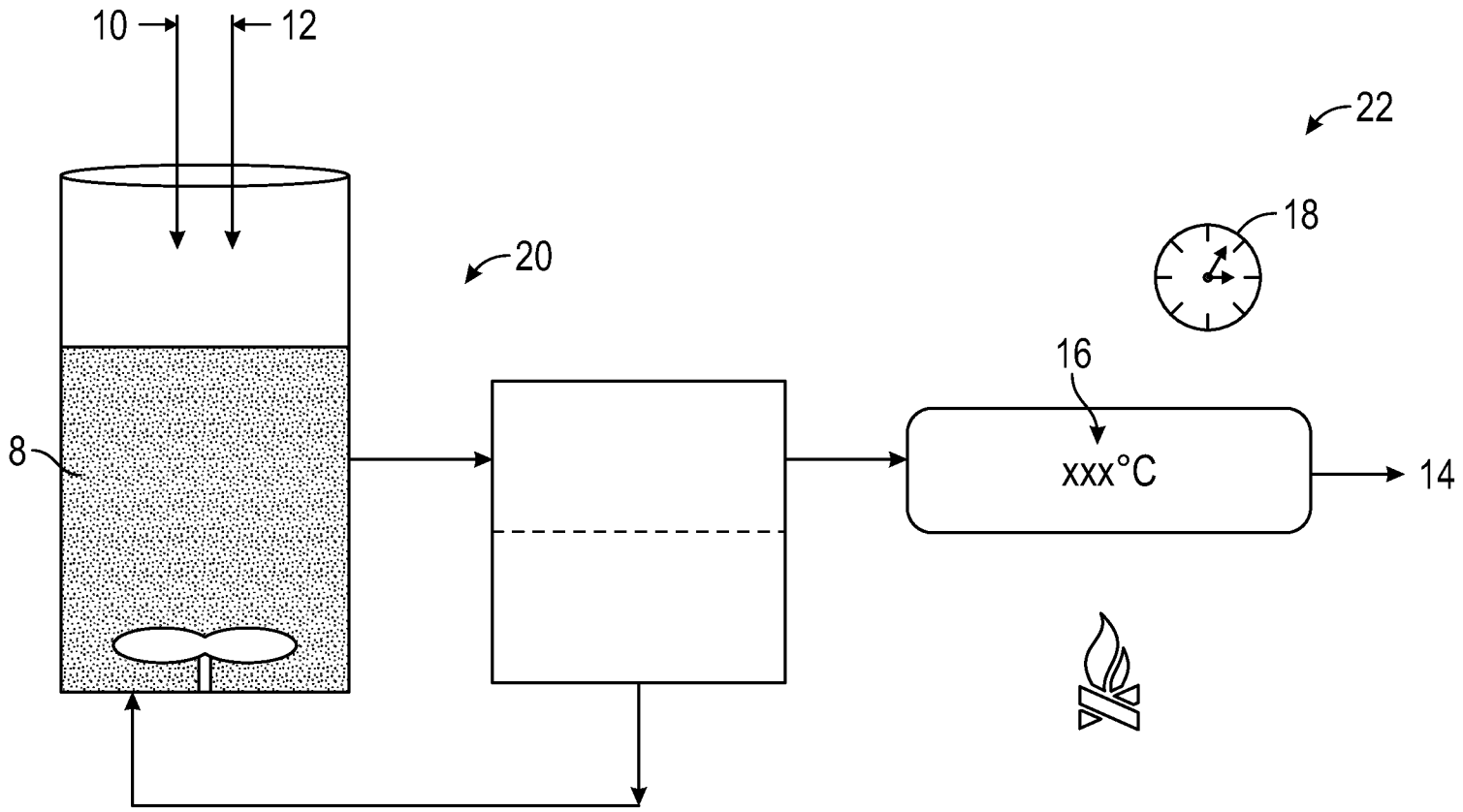
FIGS. 1 and 2 are schematic diagram of different embodiments of a process for producing a treated substrate, and the treated substrate.

Referring to FIG. 1, an untreated substrate 10 includes lignocellulose, where lignocellulose may include cellulose, hemicellulose, lignin, and other materials. Lignocellulose is a plant biomass. In an exemplary embodiment, the untreated substrate 10 primarily comprises wood pulp, and may comprise kraft pulp in some embodiments. As used herein, the term "primarily comprises" means the named component is about 50% by weight of the named material or more, based on a total weight of the named material. The untreated substrate 10 is a raw material for paper production in an exemplary embodiment, and may be formed from wood, cotton or other fiber crops, or other materials known to provide pulp suitable for papermaking processes. In an exemplary embodiment, the untreated substrate 10 may include from about 25 to about 100 weight percent lignocellulose, based on a total weight of the dried untreated substrate 10. Other materials may also be present in the untreated substrate 10 in various embodiments.

A polymer ingredient 12 and the untreated substrate 10 are combined in a polymer application process 20 to form a polymer substrate combination 8 in an exemplary embodiment. The polymer ingredient 12 may be applied to the untreated substrate 10 in a dry process, as illustrated in an exemplary embodiment in FIG. 2, or a wet process as illustrated in an exemplary embodiment in FIG. 1, with continuing reference to FIG. 2. In the dry process, a limited amount of polymer ingredient 12 is added to the untreated substrate 10 such that the water content remains low, such as less than about 75% moisture, based on a dry weight of the untreated substrate. Some embodiments that may utilize the dry treatment process include a coating application process, size press application, or spraying.

In alternate embodiments, the polymer ingredient 12 is added to the untreated substrate 10 in a wet process to form a polymer substrate combination 8, where the untreated substrate 10 and polymer ingredient 12 include significant amounts of water. Some exemplary embodiments that may utilize the wet process include a headbox of a pulp drying machine, a pulp chest, or into a pulp stream flowing through a pipe. In general, the amount of water in the polymer substrate combination 8 during the polymer application process 20 may vary from about 0% to about 99.9% water, based on a weight of the polymer substrate combination 8 (including any water present in the polymer substrate combination 8.) The amount of water present in the polymer substrate combination 8 is not critical.

The polymer ingredient 12 includes a polymer, and may include water and other materials in various embodiments. In the wet process, the untreated substrate 10 may be de-watered before proceeding, such as by filtration or centrifugation. The polymer ingredient 12 may be added to the untreated substrate 10 as a solution, where water is present, but may also be added as a solid or high concentration polymer in alternate embodiments. The pH of the polymer substrate combination 8 is adjusted with appropriate acid(s) and/or base(s), such as hydrochloric acid, sulfuric acid, and/or sodium hydroxide. The acid(s) and/or base(s) may be added to the polymer ingredient 12 in some embodiments, or the acid(s) and/or base(s) may be added to the untreated substrate 10 or otherwise added to the polymer substrate combination 8 in alternate embodiments. In an exemplary embodiment, the polymer ingredient 12 includes about 2 weight percent polymer, based on a total weight of the polymer ingredient 12, where water is the primary component of the polymer ingredient (i.e., over about 50 weight percent of the polymer ingredient 12). However, a wide variety of different concentrations of polymer in the polymer ingredient 12 may be utilized in alternate embodiments as long as at least some of the polymer is present. For example, the polymer ingredient 12 may include from about 0.1 to about 100 weight percent polymer or from about 0.3 to about 50 weight percent polymer, or other concentrations in various embodiments. It is also possible to use solvents other than water, or in addition to water, such as acetone, ethanol, methanol, or a wide variety of other solvents. The polymer may be hydrolyzed when present in the polymer substrate combination 8, as explained in more detail below.

The polymer in the polymer ingredient 12 includes a succinic moiety. The succinic moiety can reversibly change between a succinic anhydride moiety and a succinic acid moiety. The succinic acid moiety (often referred to as the "acid") includes two carboxylic acid moieties that react with each other to form the anhydride. The two carboxylic acid moieties are separated from each other by two atoms in the succinic acid moiety, where the two atoms are carbon atoms. The

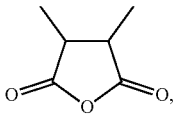

anhydride is in the form of and each carboxylic acid moiety of the succinic acid moiety is in the form of C(=O)OX, wherein X is a hydrogen atom or a compound ionically bound to the C(=O)O group, such as a chloride ion, a sulfate ion, a potassium ion, or other cations. As such, the term "succinic acid moiety" and "carboxylic acid moiety" includes the acid form, where X is a hydrogen atom, and also includes carboxylic acid salts, where X is a cation other than hydrogen. The succinic moiety includes titratable carboxyl groups, where a succinic anhydride moiety or a succinic acid moiety includes two titratable carboxyl groups, and the carboxylic acid moiety includes one titratable carboxyl group. Therefore, the total titratable carboxyl groups of the polymer include the sum of (i) the two carboxyl groups of the succinic anhydride moiety, (ii) the two carboxylic acid moieties of the succinic acid moiety, and (iii) any titratable carboxylic acid moieties of the polymer that are not part of a succinic anhydride moiety or a succinic acid moiety.

The polymer may have a weight average molecular weight of from about 1 to about 100,000 kilodaltons or more in some embodiments. In an exemplary embodiment, the polymer has a weight average molecular weight of from about 2 to about 10,000 kilodaltons, but in an alternate embodiment the polymer has a weight average molecular weight of from about 20 to about 100 kilodaltons. However, other weight average molecular weights may be utilized in alternate embodiments.

In an exemplary embodiment, the polymer is a copolymer formed from maleic anhydride or maleic acid with another compound that will polymerize with maleic anhydride or maleic acid. The other compound may include a double bond, such as an alkene, and may include other functional groups, such as acrylics, methacrylics, or other compounds. For example, the polymer may be a copolymer of maleic anhydride, maleic acid, or combinations thereof with a monomer selected from acrylic acid, methacrylic acid, styrenesulfonic acid, vinylsulfonic acid, acrylamidomethylpropane sulfonic acid, diallyldimethylammonium salt, acryloylethyltrimethyl ammonium salt, acryloylethyl dimethylamine, ethacryloylethyltrimethyl ammonium salt, ethacryloylethyl dimethylamine, methacryloylethyl trimethyl ammonium salt, methacryloylethyl dimethylamine, acrylamidopropyltrimethyl ammonium salt, acrylamidopropyl dimethylamine, methacrylamidopropyl trimethyl ammonium salt, methacrylamidopropyl dimethylamine, vinylformamide, vinylamine, acrylamide, methacrylamide, N-alkylacrylamide, vinylformamide, ethylene, methyl vinyl ether, octadecene, styrene, isobutylene, butadiene, and mixtures thereof.

In an exemplary embodiment, the polymer includes poly (ethylene-co-maleic acid) compounds, where the term "maleic acid," when used in the name of a polymer, refers to a moiety that may be reversibly changed between the succinic acid moiety and the succinic anhydride moiety. The maleic group may provide the polymer with succinic moieties, such as the succinic anhydride and/or the succinic acid moieties, and other co-monomers may optionally also provide succinic moieties and/or carboxylic acid moieties on the polymer. In an exemplary embodiment, the polymer includes poly(ethylene-co-maleic acid), poly(butadiene-co-maleic aid), and combinations thereof. In an alternate embodiment, the polymer includes poly(ethylene-co-maleic acid).

In an exemplary embodiment, the polymer substrate combination 8 is adjusted to a pH of about 4. In different exemplary embodiments, polymer substrate combination 8 may be adjusted to a pH of from about 2 to about 5, or a pH of about 3 to about 4.5, or a pH of about 3.5 to about 4.5. The low pH (at a value of less than about 5) ensures at least some of the succinic moiety includes succinic acid moieties, which may aid in a reaction with a hydroxy moiety of the lignocellulose to form an ester bond. In some embodiments, the pH of the polymer substrate combination 8 is adjusted by adjusting the pH of the polymer ingredient 12, where the polymer ingredient 12 is applied as an aqueous solution. In some embodiments, the polymer substrate combination 8 is free of a catalyst. For example, specific catalysts that may not be present (i.e., which may be excluded) include, but are not limited to, alkali metal hypophosphites and phosphites, (i.e., $MH_2PO_2$, $MH_2PO_3$ and $M_2HPO_3$), where M is an alkali metal; an alkali metal salt of polyphosphoric acid; lithium dihydrogen phosphate; sodium dihydrogen phosphate; potassium dihydrogen phosphate; sodium hypophosphite; sodium salt of dichloroacetic acid; p-toluenesulfonic acid; 1,4-dimethylaminopyridin; 1-methylimidazole; and combinations thereof. As used herein, the term "not present" means the named component is present in a concentration of 0.01 weight percent or less, based on a total weight of the named composition, (i.e., the polymer substrate combination 8).

Figure 2:
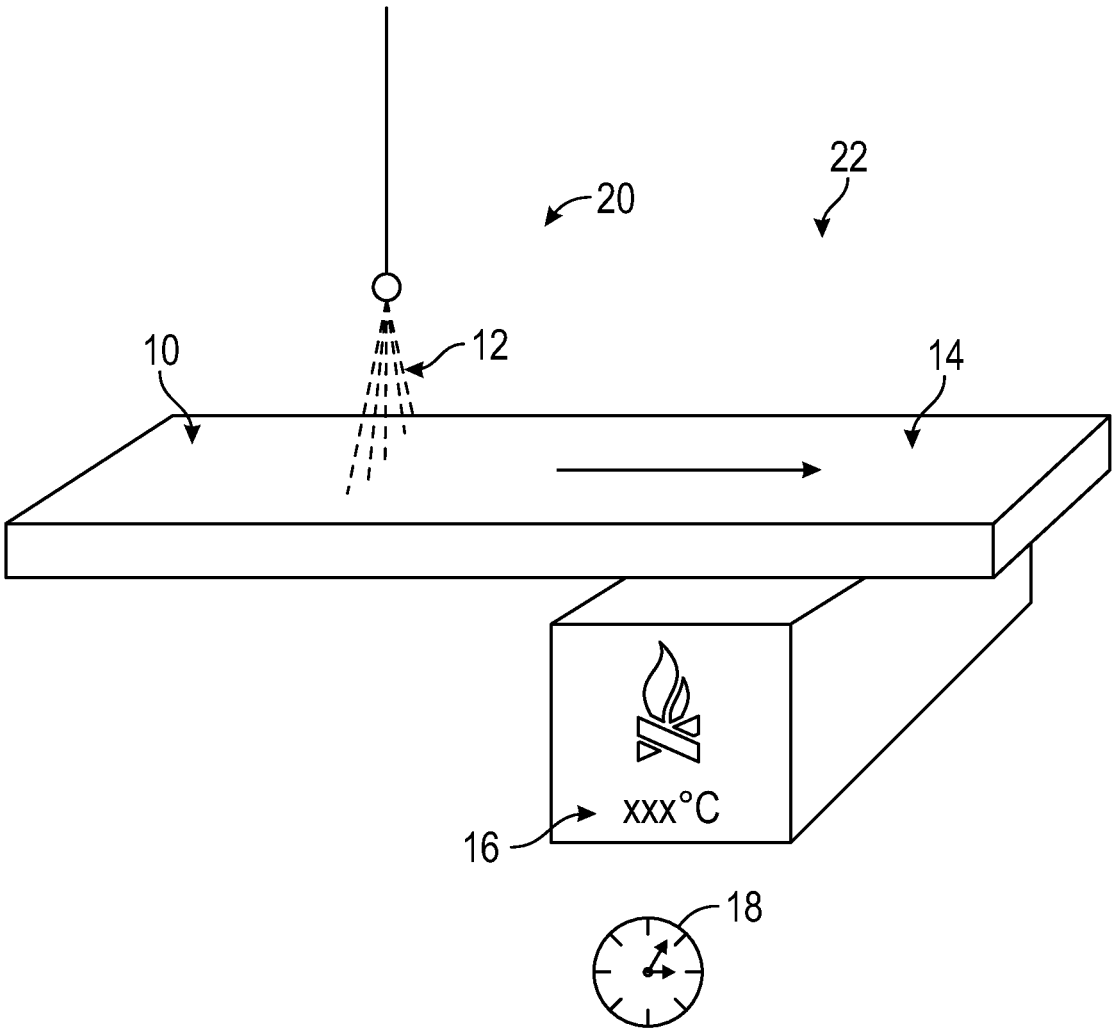
Figure 3:
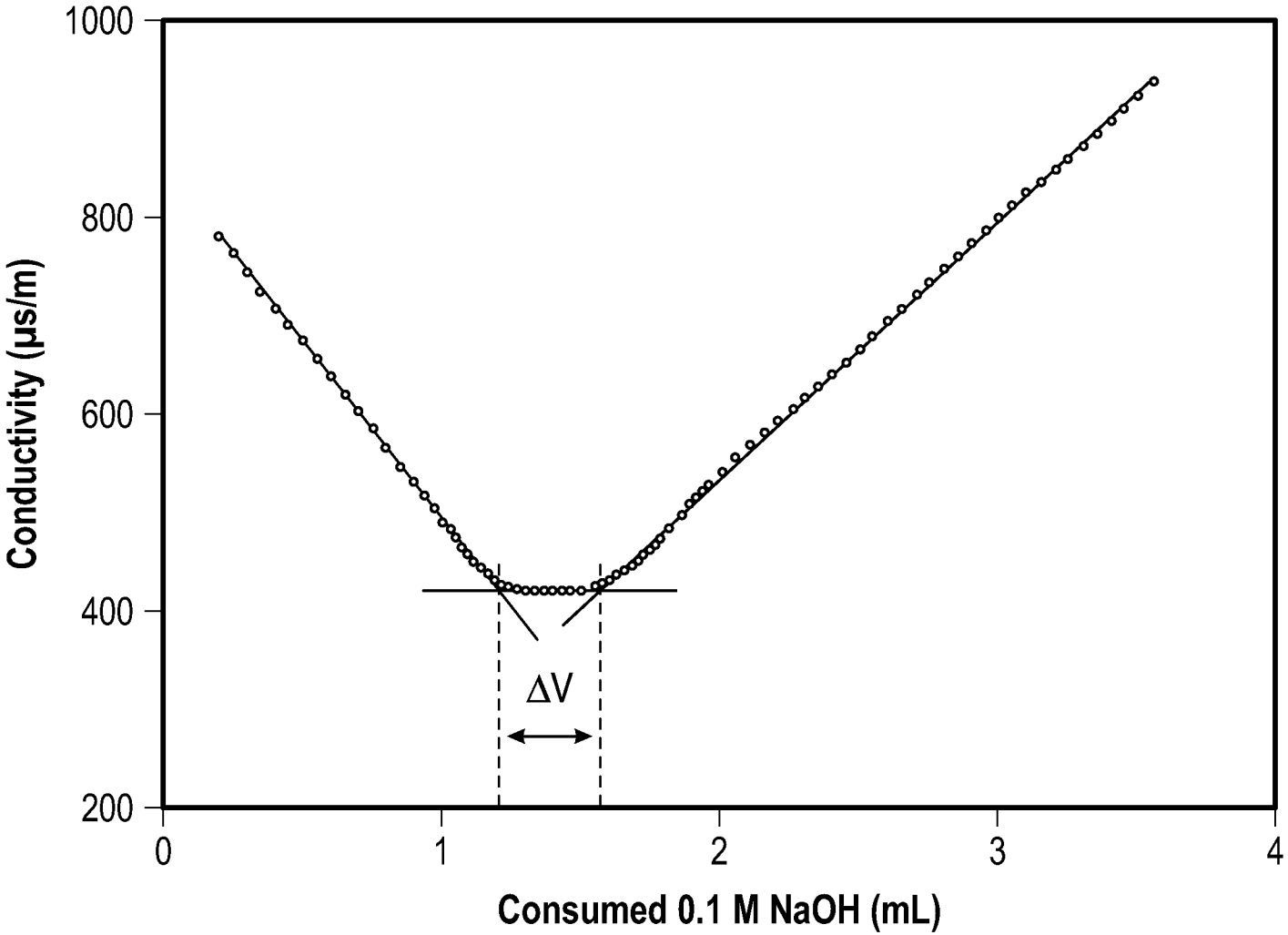
FIGS. 3-11 are charts showing experimental results for various aspects and factors influencing the results of the present disclosure.

Still referring to FIGS. 1 and 2, the polymer is fixed to the untreated substrate 10 in a curing process 22 to form a treated substrate 14. Not to be bound by theory, but in an exemplary embodiment it is assumed that at least some of the polymer forms an ester linkage with the lignocellulose, where a succinic anhydride of the polymer reacts with a hydroxy group of the lignocellulose to form the ester linkage. Some of the polymer may also be physically fixed to the treated substrate 14 without being covalently bonded. Physically fixed polymer will not wash out of the treated substrate 14 in aqueous solutions, even after agitation and soaking for a period of two days. As such, any polymer physically fixed to the treated substrate 14, but which may not be covalently bonded, remains with the treated substrate 14 during subsequent processing, so the benefits of the polymer are displayed by paper made from the treated substrate 14. Not to be bound by theory, but it is hypothesized that essentially all of the polymer is covalently bonded to the treated substrate 14, and physical fixation may be an insignificant factor. The amount of polymer present may be expressed as the "added polymer," which includes the total amount of polymer added to the untreated substrate 10, and which may be referred to as an added gamma (Fa). The "fixed polymer," which is the amount of polymer fixed to the treated substrate 14, may be referred to as a fixed gamma ($\Gamma_f$). The amount of fixed polymer divided by the added polymer (Fr/Fa) gives the fixation yield of the curing process 22.

The curing process 22 includes applying heat to the untreated substrate 10 wetted with the polymer ingredient 12. In an exemplary embodiment, the untreated substrate 10 and polymer ingredient 12 are heated to a curing temperature 16 of at least about 100 degrees Celsius (° C.) for a curing time 18. In alternate embodiments, the untreated substrate 10 and polymer ingredient 12 are heated to a curing temperature 16 of from about 120° C. to about 500° C., or a temperature of about 150° C. to about 400° C., or about 180° C. to about 300° C. The untreated substrate 10 and polymer ingredient 12 are exposed to the curing temperature 16 for a curing time 18 sufficient to fix the fixed polymer to the treated substrate 14, but where the curing time 18 is brief enough that the wet tensile index remains below the desired value, as described more fully below. In some embodiments, the curing process 22 may be a multi-step curing process 22 that involves two or more separate heating processes (not illustrated), where the untreated substrate 10 and the polymer ingredient 12 are heated in a first step, and then re-heated again in subsequent step(s).

Reference herein to the "wet tensile index" of the treated substrate 14 refers to a wet tensile index of a handsheet formed from the treated substrate 14, where a mass of the dry handsheet includes at least about 90 weight percent of the treated substrate 14, based on a weight of the dry treated substrate 14. The wet tensile index measurement as used herein is defined as the wet tensile index of a handsheet, so direct measurement of a treated substrate 14 in a form other than a handsheet is not applicable. The handsheet may be formed by a variety of methods, where an exemplary method is described in the "EXAMPLES" section below. As such, the term a "wet tensile index" of a treated substrate 14 is comparable to a wet tensile index of a handsheet formed from the treated substrate 14.

A beta gamma product of the treated substrate ($\beta\Gamma_a$) may be useful in determining an appropriate curing time 18, but the desired value of the $\beta\Gamma_a$ varies with different types of untreated substrates 10 and with different types of polymers. Besides the type of untreated substrate 10 and polymer, the curing time 18 will vary with many other factors, including but not limited to the thickness of the untreated substrate 10 when exposed to the curing temperature 16, the amount of water absorbed in the untreated substrate 10, the amount of water freely mixed with the untreated substrate 10, the rate at which the temperature is brought up to the curing temperature 16, the type of equipment utilized, and other variables. The curing time 18 will be limited, because the longer the exposure, the greater the wet tensile index, and the greater the beta gamma product.

Exemplary curing times 18 may be from about 30 seconds to about 2 hours, or from about 30 seconds to about 1 hour, or from about 1 minute to about 30 minutes, or from about 1 minute to about 15 minutes, or from about 1 minutes to about 10 minutes. The curing time 18 includes the sum of all the heating period time in each of heating process of a multi-step curing process 22. Residual heat in the treated substrate 14 may contribute to further curing once removed from a source of heat, and this residual heat should be included in the process calculation for determining the $\beta\Gamma_a$. In an exemplary embodiment applicable to a commercial papermaking process, the curing time 18 may be the time a wet pulp is in a dryer section of the of a pulp drying machine. The polymer ingredient 12 may be applied to the untreated substrate 10 prior to, within, or after the dryer section of a pulp drying machine. The residence time and/or temperature in the dryer section may be adjusted to provide adequate fixation with a satisfactory wet tensile index. A beta gamma product corresponding to a wet tensile index of 3 newton meters per gram of treated substrate ($\beta\Gamma_{a3}$), as described more fully below, may be determined in a laboratory for a desired type of pulp and a desired polymer, where the $\beta\Gamma_{a3}$ may guide the determination of the residence time and temperature in the dryer section. The treatment process may include other techniques, either in addition or in place of the dryer section, where the untreated substrate 10 may be exposed to infrared driers, heating ovens, or other techniques of applying heat to the untreated substrate 10 and the polymer ingredient 12.

Not to be bound by theory, but it is speculated that the succinic moiety converts to the succinic anhydride moiety as the curing time 18 progresses, so longer exposure results in more succinic acid moieties converting to the succinic anhydride moieties. It is also possible that longer curing times 18 produce more covalent bonds linking the polymer, or other mechanisms. In any event, the desired level of wet tensile index result when the curing process 22 is controlled and terminated before the wet tensile index increases too much, such as to a level of greater than about 3 newton meters per gram.

The fixed gamma ($\Gamma_f$) value represents the amount of polymer fixed to the treated substrate 14, and is measured in milliequivalents of titratable carboxyl groups of the polymer per gram of dry treated substrate (meq/g). All carboxylic acids and anhydrides are titratable, where the succinic anhydride moieties tend to convert to the succinic acid moieties when exposed to water. The lifetime of anhydrides in water is short because they quickly revert to acid, so all carboxylic acid and anhydride groups are measured during the titration, as mentioned above. The treated substrate 14 is titrated to measure the titratable carboxylic groups, so the initial titration includes titratable carboxyl groups attributable to the polymer combined with any titratable carboxyl groups attributable to the untreated substrate 10. The amount of titratable carboxyl groups on the untreated substrate 10 is measured before the treatment process is initiated, and this value is subtracted from the amount of titratable carboxyl groups found after the treatment process to determine the amount of polymer fixed to the treated substrate 14, measured in milliequivalents of titratable carboxyl groups of the polymer per gram of dry treated substrate 14. The milliequivalents of titratable carboxyl groups can be measured by conductometric titration. The treated substrate 14 may be washed before the titration to remove any polymer remaining in the treated substrate 14 that is not fixed.

To convert meq/g of the polymer to the mass of an exemplary polymer, such as grams of poly(ethylene-co-maleic anhydride)(PEMA) per g of dry pulp, multiply meq/g by the carbonyl equivalent weight of the polymer, which for PEMA is 63.05 Daltons. The treated substrate 14 should have a certain minimum amount of polymer fixed to it to provide the desired available carboxylic acid groups. Therefore, the fixed gamma ($\Gamma_f$) value should be at least about 0.001 meq/g, such as a $\Gamma_f$ value of from about 0.001 to about 4 meq/g. In an alternate embodiment, the $\Gamma_f$ value for the treated substrate 14 is from about 0.001 to about 1 meq/g, or about 0.005 to about 0.5 meq/g.

The wet tensile index of the treated substrate 14 is measured. In an exemplary embodiment, the wet tensile index is measured with a Tappi Standard wet tensile index test, such as TAPPI methods T456 om-10 and/or T494 om-96. Other wet tensile index tests may also be used in alternate embodiments, such as modifications of the TAPPI methods, such as changes in the test strip size of the number of repetitions. In an exemplary embodiment, the wet tensile index for the treated substrate 14 is from about 0 to about 3 newton meters per gram (Nm/g). Reference to the wet tensile index of a treated substrate 14 means the wet tensile index of a handsheet prepared from the treated substrate 14, as mentioned above. Experience suggests the treated substrate 14 may be repulped without excessive effort if the wet tensile index is about 3 Nm/g or less, but repulping efforts become prohibitive if the wet tensile index is above about 3 Nm/g. However, the treated substrate 14 is easier to repulp if the wet tensile index is about 2.5 Nm/g or less, and even easier to repulp if the wet tensile index is about 2 Nm/g or less. Therefore, in alternate embodiments, the wet tensile index of the treated substrate 14 may be from about 0.5 to about 2.5 Nm/g, or from about 0.5 to about 2.2 Nm/g or less, or from about 0.5 to about 2 Nm/g. Easier repulping of the treated substrate 14 may lead to lower paper manufacturing costs, because less time and effort are required for repulping.

Beta (β) is the fraction of succinic acid moieties that have been converted to succinic anhydride moieties, which may occur during curing. It is proposed that β is a good single measure of the progress of curing during the treatment process. The β value is a dimensionless fractional value ranging from 0 to 1. Methods for estimating β are described below in the EXAMPLES section. Actual measurement of the number of succinic anhydride moieties divided by the total number of succinic moieties is difficult. The β value has been estimated by a model for the results presented herein, as explained in the EXAMPLES section below, where reaction rate calculations are used. The β value only represents the succinic moieties converted to the succinic anhydride form, and does not include any carboxylic acid moieties present in the treated substrate 14 that are not part of the succinic moieties, such as any carboxylic acid moieties present on hemicellulose or otherwise present in the untreated substrate 10, or any carboxylic acid moieties on the polymer that are not part of the succinic moieties. This would include such things as a carboxylic acid moiety on the polymer from an acrylic copolymer. Any carboxylic acid moieties present in the treated substrate 14 that are not part of the succinic moiety are subtracted or removed from the calculation of the beta value.

The wet tensile index has been shown to be related to the beta gamma product of the treated substrate ($\beta\Gamma_a$), where the $\beta\Gamma_a$ is a result of multiplying the α value (a unitless number) by the Fa value, where the Fa value is measured in meq/g, as described above. This $\beta\Gamma_a$ can be correlated to the wet strength of the treated substrate 14 resulting from the contributions of (i) the amount of added polymer and (ii) the degree to which the polymer and the treated substrate 14 are cured. The wet strength of the treated substrate 14 is measured and discussed herein as the wet tensile index. If the $\beta\Gamma_a$ product becomes too high, the wet tensile index grows and the treated substrate 14 becomes difficult to repulp. The wet tensile index has been measured for pulp treated while dry in the EXAMPLES section below, but the results are applicable to pulp treated when wet, so the $\beta\Gamma_a$ product indicates if the pulp is re-pulpable despite the method of treatment. The curing process 22 requires heat, so the treated substrate 14 is dried to some extent at the termination of the curing process 22 because water is evaporated and/or boiled off. The value of the $\beta\Gamma_a$, in the units described above, can be determined in a laboratory, and this may simplify determination of the variables in the curing process 22 that produce a treated substrate 14 with a sufficiently low wet tensile index.

In an exemplary embodiment, the $\beta\Gamma_a$ product is determined for a series of curing conditions and a beta gamma product corresponding to a wet tensile index of 3 newton meters per gram of treated substrate ($\beta\Gamma_{a3}$) can be determined by measuring the $\beta\Gamma_a$ in meq/g corresponding to the wet tensile index of 3 Nm/g for the treated substrate 14, in the form of a treated laboratory handsheet, as mentioned above. Therefore, $\beta\Gamma_{a3}$ predicts conditions for the curing process 22 that will lead to a wet tensile index of 3 Nm/g. Alternate beta gamma products may be determined for other desired maximum wet tensile indices, such as a wet tensile index of 2 Nm/g, in alternate embodiments. A laboratory determination of $\beta\Gamma_{a3}$, (or any other beta gamma product for an alternate desired wet tensile index), may be determined for each different combination of pulp and polymer.

Combinations of strong untreated substrates 10 and high molecular weight polymers tend to have high fixation yields, so control of the curing time 18 and curing temperature 16 to limit the β value helps limit the wet tensile index and the corresponding $\beta\Gamma_a$ to below the desired value. Fixation yields tend to be lower for low molecular weight polymers, so control of the curing time 18 and curing temperature 16 help to increase the fixation yield. The $\beta\Gamma_a$ product is an effective way to balance the competing challenges of different molecular weights of the polymer.

The following experimental data is provided to demonstrate the details of this disclosure. The graphs in FIGS. 3-12 should be viewed with continuing reference to FIGS. 1 and 2.

EXAMPLES

Materials. Poly(ethylene-co-maleic anhydride) (PEMA, Mw 100-500 kDa), was repurchased from Sigma-Aldrich®. ZeMac® E60 (PEMA Mw 60 kDa) was supplied by Vertellus®, US. Never-dried northern softwood bleached was provided by ®, Canada. TAPPI standard blotter papers were purchased from Labtech Instruments™ Inc., Canada. All the other chemicals were purchased from Sigma-Aldrich®.

Testing of the pH of the polymer ingredient 12 during treatment of the untreated substrate 10 demonstrated that pH has a significant influence on the retention of polymer by the treated substrate 14.

Polyanhydride Hydrolysis. Polyanhydride copolymers were hydrolyzed to the corresponding polyacids. In a typical hydrolysis experiment, 1 gram of poly(ethylene-co-maleic anhydride), sometimes referred to herein as PEMA, powder was dispersed in 49 grams (g) of 1 millimolar (mM) sodium chloride (NaCl) solution. Most of the experiments herein were conducted in dilute salt to control the ionic strength. After 2 days, the poly(ethylene-co-maleic acid) (PEMAc) solution was clear.

Handsheet Preparation. Pulp sheets were prepared for polymer treatment (75 grams per square meter (g/m$^2$)). The pulp sheets were made with never-dried bleached pulp (15 g, dry mass) was diluted to 2 liters (L) with deionized water and disintegrated in a British disintegrator (Labtech® Instruments Inc., model 500-1) for 15,000 revolutions. 200 milliliters (mL) of 0.75% pulp was added to a semiautomatic sheet former (Labtech® Instruments Inc., model 300-1) where the pulp was further diluted to 0.019% with deionized water before dewatering. Wet handsheets were pressed (Standard Auto CH Benchtop Press, Carver®, Inc., US) between blotters pads with a pressure of 635 kilopascals (kPa) for 5 minutes (min) at room temperature (about 23° C.). The pressed sheets were placed in drying rings to dry overnight at 50% relative humidity and 23° C.

Pulp Treatment. In a typical treatment experiment, 3 mL of 2 wt % PEMAc solution at the desired pH was added dropwise across the surface of a dry pulp sheet (~1.5 g, 75 g/m$^2$) over about 2 min. The wet pulp sheet was then placed between two blotter papers and rolled with two passes using a Technical Association of Pulp and Paper Industry (TAPPI)-standard brass couch roller (102 millimeter (mm) diameter and 13 kilogram (kg) mass) to remove excess polymer ingredient 12. The sheet was weighed before treatment and after pressing to facilitate calculating the mass of applied polymer. The treatment sheet was cured between two blotting papers on a speed dryer (Labtech® Instruments Inc.) at the curing temperature 16 for the curing time 18, such as at 120° C. for 10 min.

The amount of polymer that could be washed off the pulps was measured to estimate the quantity of polymer remaining fixed to the fibers. Specifically, a pulp sheet was placed in 200 mL of 1 mM NaCl solution in a 250 mL beaker. Not to be bound by theory, but it is possible a carboxyl group of the polymer reacts with a hydroxy group of the ester to form a covalent ester linkage between the polymer and the treated substrate 14. Some of the polymer may also be physically fixed to the treated substrate 14, where there is no covalent chemical bond between the polymer and the treated substrate 14, but the polymer may be adhered or otherwise physically connected to the treated substrate 14 without a covalent bond. After stirring 30 min with a magnetic stirring bar, the pulp was filtered to separate the fibers and the polymer content in the wash solution was measured by conductometric titration. The washing procedure was repeated to ensure there was no polymer in the second wash solution.

Washing for Fixation Yield. The amount of polymer that could be washed off the pulps was measured to estimate the quantity of polymer remaining fixed to the fibers. Specifically, a pulp sheet was torn into small pieces that were added to 200 mL of 1 mM NaCl solution in a 250 mL beaker. After stirring 30 min with a magnetic stirring bar, the pulp was filtered to separate the fibers. The washing procedure was repeated. The polymer contents of the washing solutions were measured to calculate the PEMAc bonding yield based on the wash solution. The PEMAc content of the fibers was also directly measured by conductometric titration. In cases where the wet strength was high, the pulp sheets were repulped using a NutriBullet® Baby Bullet® blender followed by a standard disintegrator (30,000 revolutions (r)) to separate the pulp into individual fibers.

Polyelectrolyte Titration The quantity of fixed PEMAc on exterior fiber surfaces was measured by polyelectrolyte titration. To 40 mL poly(diallyldimethylammonium chloride) (PDADMAC) (1.177 meq/L) in 1 mM NaCl was added approximated 0.1 g dry mass of wet, washed PEMAc grafted pulp. The suspension was mixed with a magnetic stirring bar for 30 min at pH 10 to facilitate PDADMAC adsorption. The suspensions were then filtered on a 4.7 cm Buchner funnel fitted with Whatman® 5 qualitative filter paper. The unabsorbed PDADMAC concentration in the filtrate was determined by titration with potassium polyvinylsulfate (PVSK) (1 meq/L). The endpoint was determined with a Mütek® PCD-03 particle charge detector. The charge of the starting cellulosic substrate was subtracted to determine the quantity of fixed PEMAc.

Wet Strength Measurements. Paper specimens (1.5 cm×14 cm) were cut from conditioned paper sheets and then were soaked in 1 mM NaCl for 5 min before testing. Excess water was removed by slight pressing between two blotter papers. The tensile strength was measured with an Instron® 4411 universal testing system fitted with a 50 newton load cell (Instron® Corporation, Canton, Massachusetts) generally following the TAPPI methods T46 om-10 and T494 om-96. The crosshead speed was 25 millimeters per minute (mm/min). Each type of paper was measured at least three times.

PEMAc Quantification. Conductometric titration was used to measure PEMAc concentrations in solutions and on pulp fibers. To a wet pulp sample (dry mass 0.2 g) was added 90 mL, 4 mM NaCl solution. The initial pH was adjusted below 3.0 by adding 1 M hydrochloric acid (HCl). 0.1 M NaOH solution was added at the rate of 0.05 mL/min up to pH 11.5 by using an auto titrator (MANTECH, Benchtop Titrator Model, MT-10). Titrations were repeated with fresh samples at least three times. The volume of base consumed by the weak carboxyl groups was determined by the points of intersection of three trendlines going through the linear sections of the titration curve, as shown in an example in FIG. 3.

Figure 4:
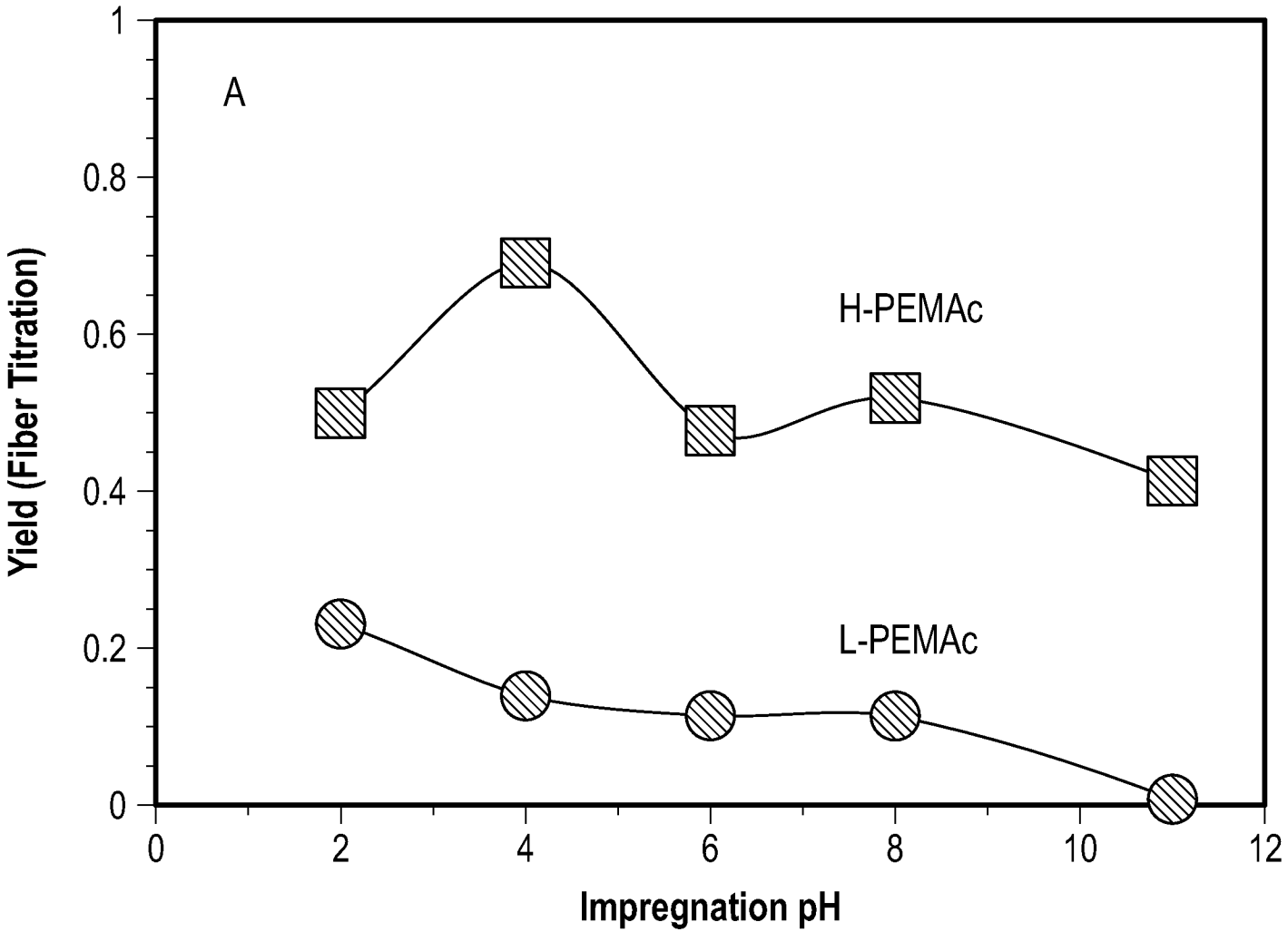
Figure 5:
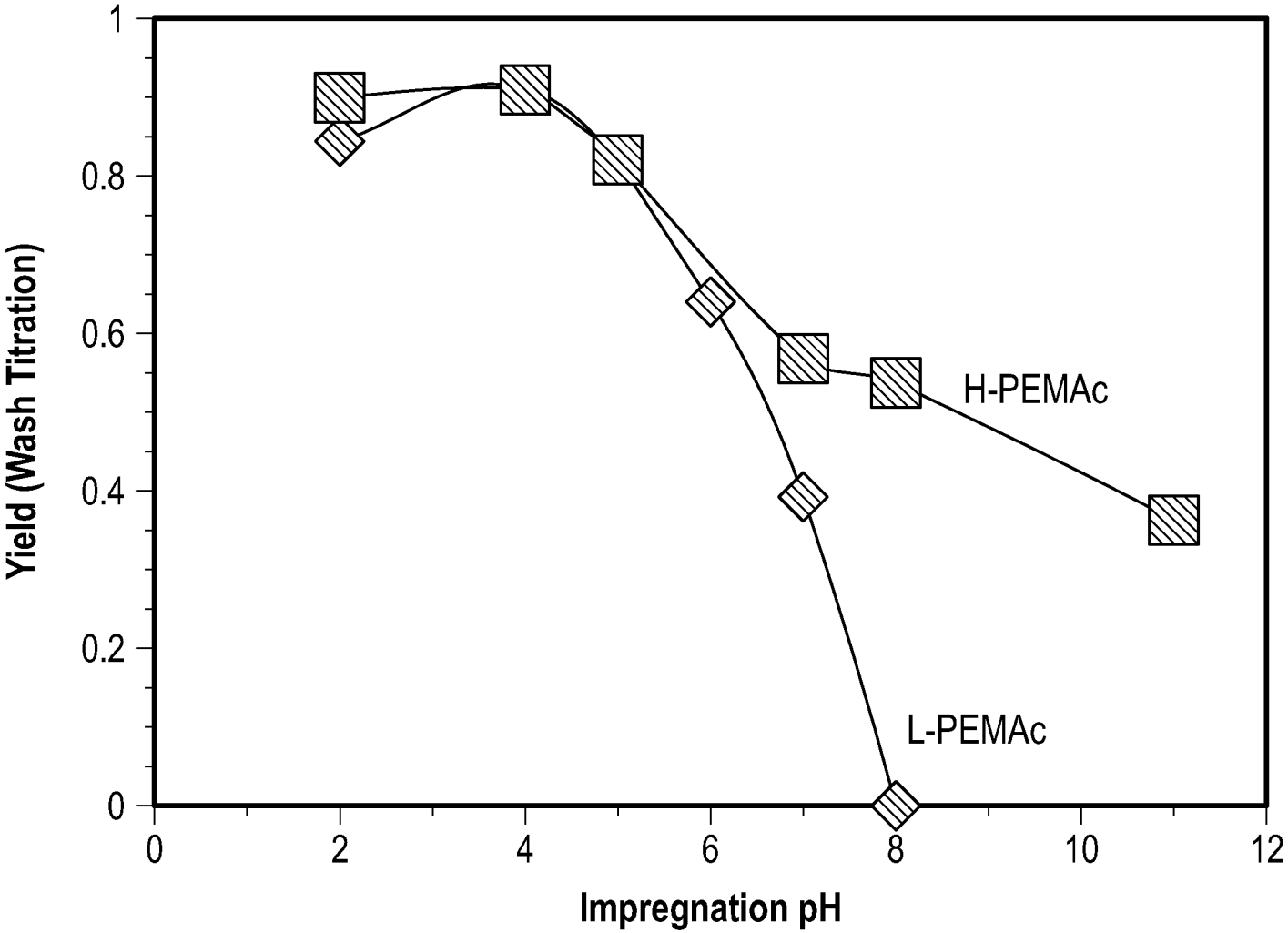

FIGS. 4 and 5 show the fixation yield dependencies on the pH of the treatment polymer ingredient 12, the curing temperature 16, and PEMAc molecular weight. H-PEMAc refers to high molecular weight poly(ethylene-co-maleic acid) with a molecular weight of from about 100 to about 500 kilodaltons (kDa), and L-PEMAc refers to low molecular weight poly(ethylene-co-maleic acid) with a molecular weight of about 60 kDa. FIG. 4 shows the treatment yield as a function of treatment solution pH and the PEMAc molecular weight for pulp sheets cured at 23° C. for greater than 12 hours. At this temperature, no chemical conversion of succinic acid moieties to succinic anhydride moieties is expected. Physical fixation is the only operative mechanism. The fixation yield for H-PEMAc (100-500 kDa) was about 50% from pH 2-11 with a peak of about 70 at pH 4. The H-PEMAc is shown with square data points, and the L-PEMAc is shown with circular data points throughout the Experimental Data graphs. The corresponding fixation yields for pulps cured at 120° C. for about 10 minutes are shown in FIG. 5. Note that the high yield samples could not be repulped for titration so the yields were based on wash water measurements. When the treatment solution is acidic, the yields are high and independent of PEMAc molecular weight suggesting chemical curing. Whereas with basic solutions the H-PEMAc yield levels at 0.4 due to physical fixation, whereas no L-PEMAc remained on the washed pulp.

Figure 6:
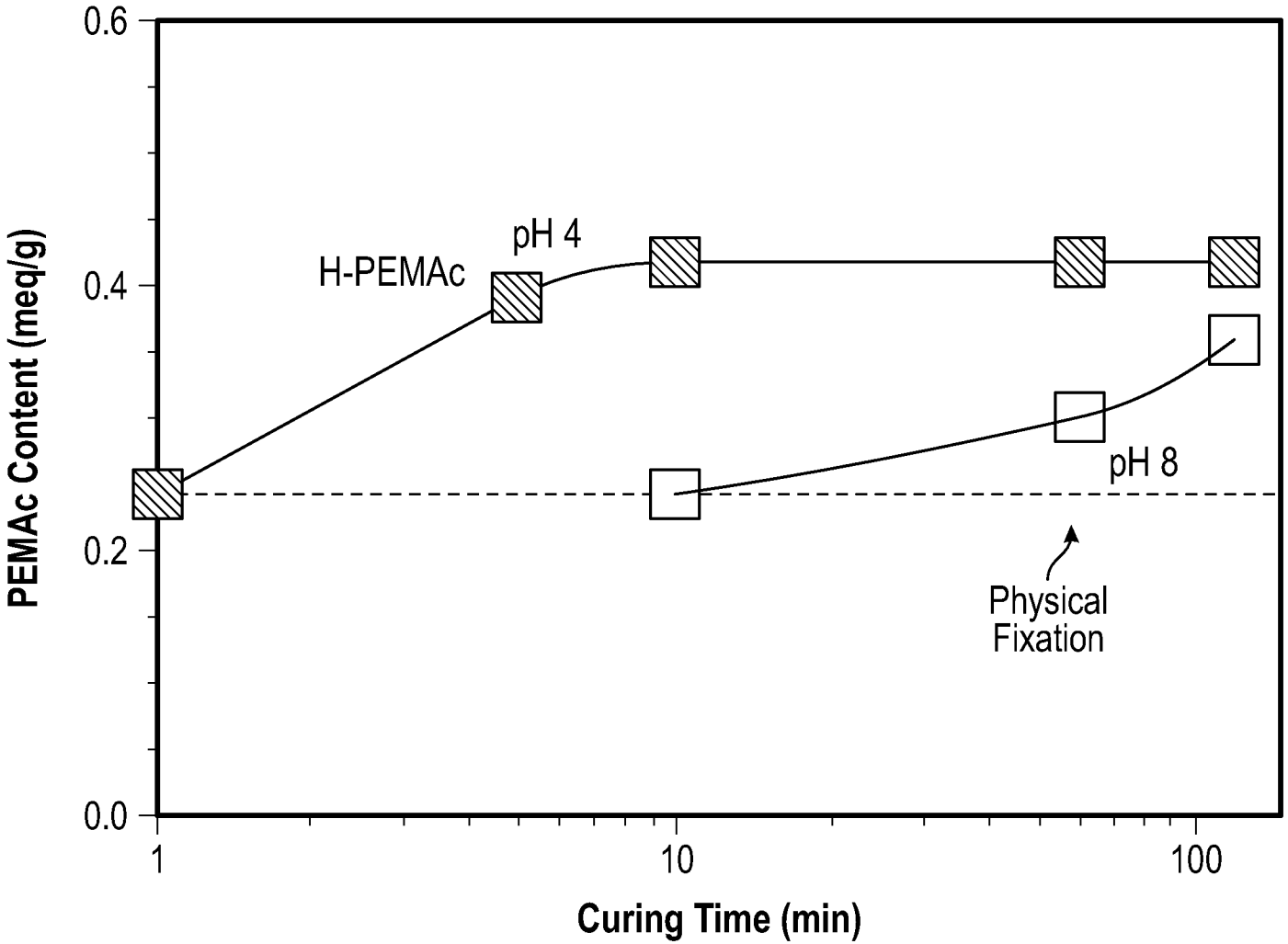
Figure 7:
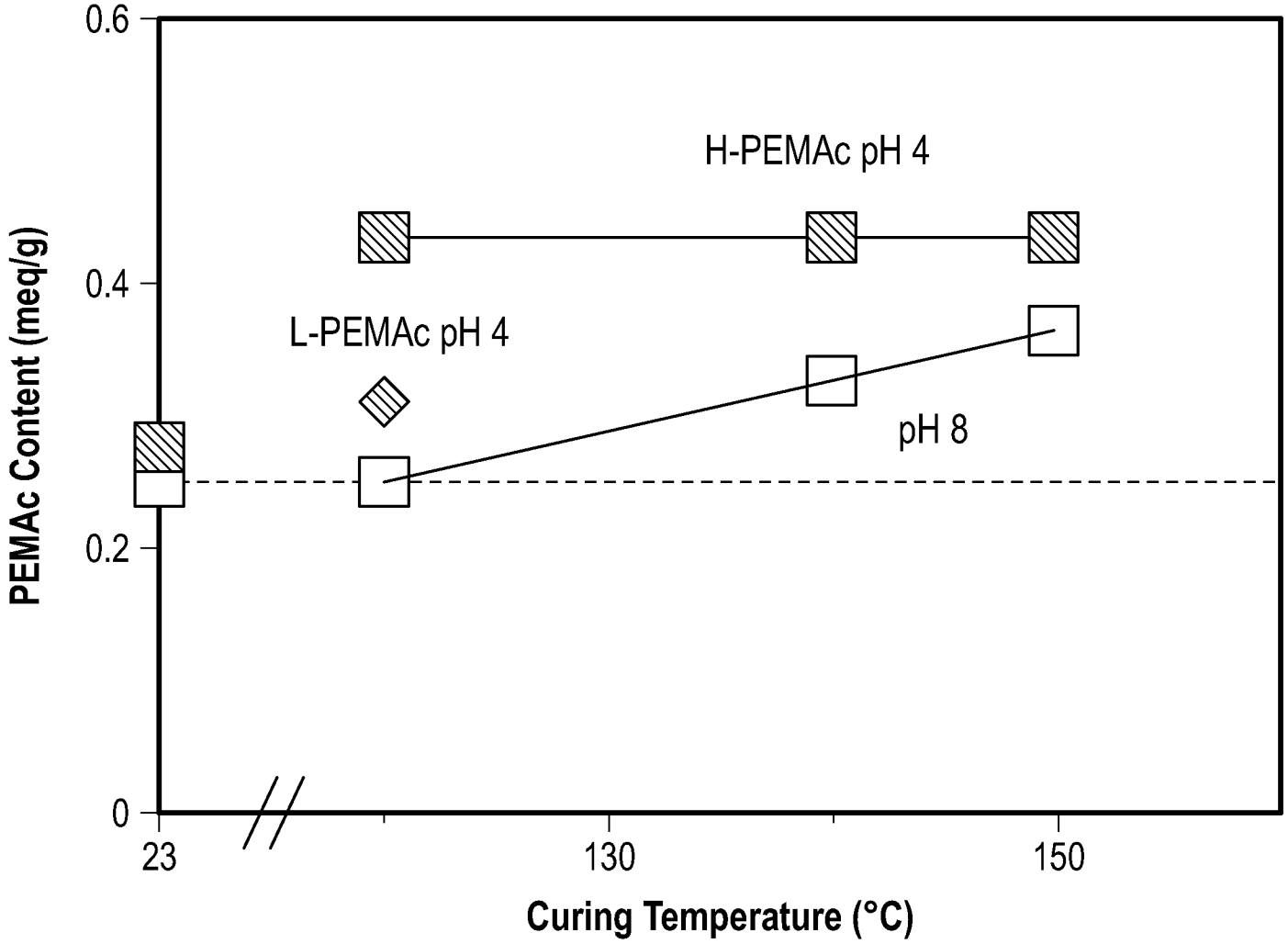

The Influence of Curing Time and Temperature. FIGS. 6 and 7 shows the influences of curing time 18, curing temperature 16, and PEMAc molecular weight, on the PEMAc content of washed fibers. FIG. 6 illustrates a constant curing temperature 16 of about 120° C., with the curing time 18 shown on the X axis, and FIG. 7 shows a constant curing time 18 of 10 minutes with the curing temperature 16 shown on the X axis. Curing of the H-PEMAc is illustrated in FIGS. 6 and 7, with the solid boxes indicating pH 4 polymer ingredient 12 and the open boxes indicating pH 8 polymer ingredient 12. With pH 4 treatment, most of the added polymer was fixed after 10 min curing at 120° C., therefore increasing the curing time 18 or curing temperature 16 had little impact. L-PEMAc gave much lower polymer contents than did H-PEMAc. Physical fixation was far less effective with L-PEMAc.

Figure 8:
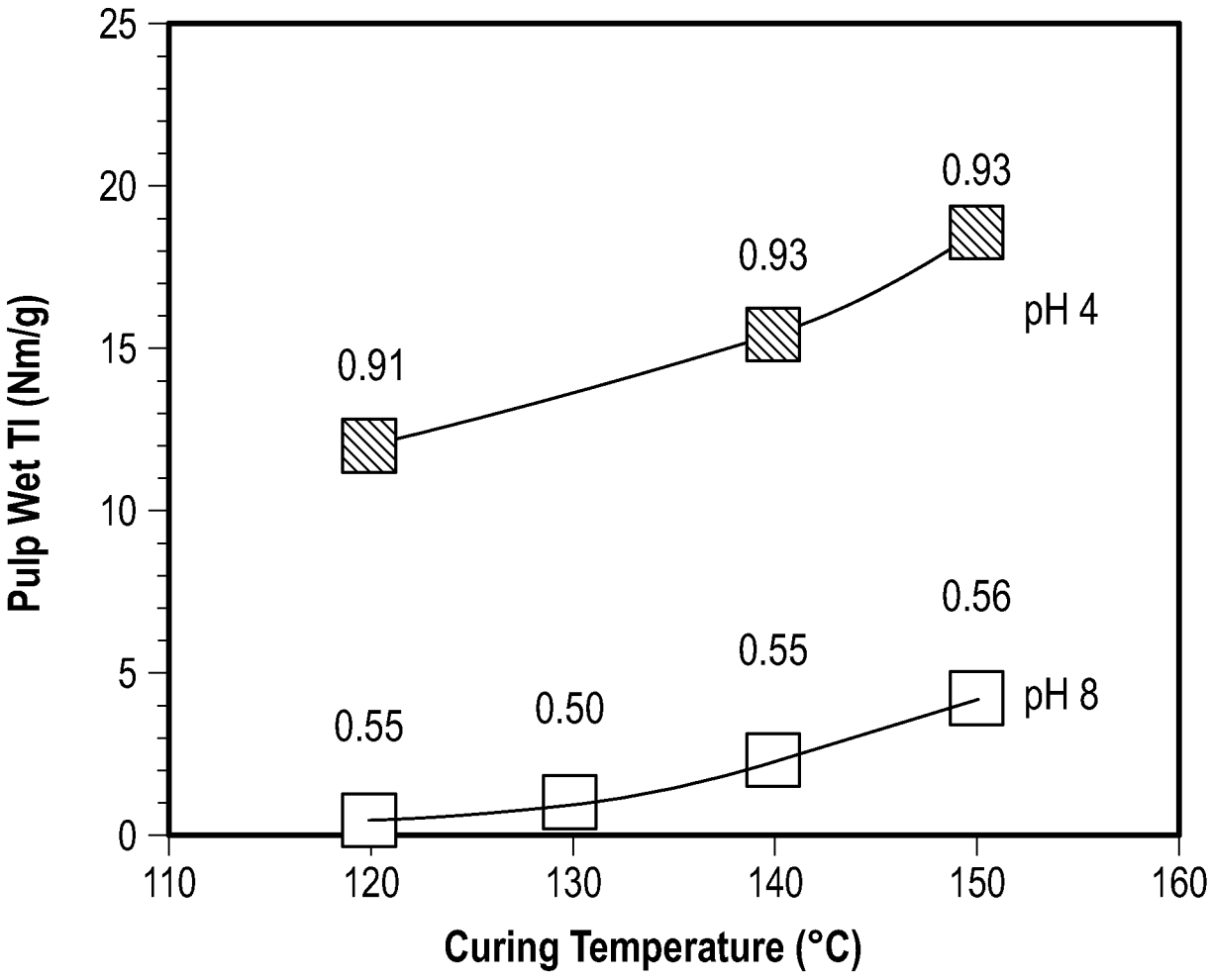

FIG. 8 shows the influence of curing temperature 16 on wet strength. The solid boxes indicate pH 4 polymer ingredient 12 was used, and the open boxes indicate pH 8 polymer ingredient 12 was used, where the curing time 18 was 10 minutes, and the variable curing temperature 16 is shown on the X axis. Wet strength increases with curing temperature 16. The numbers beside the data points are the corresponding fixation yields.

Figure 9:
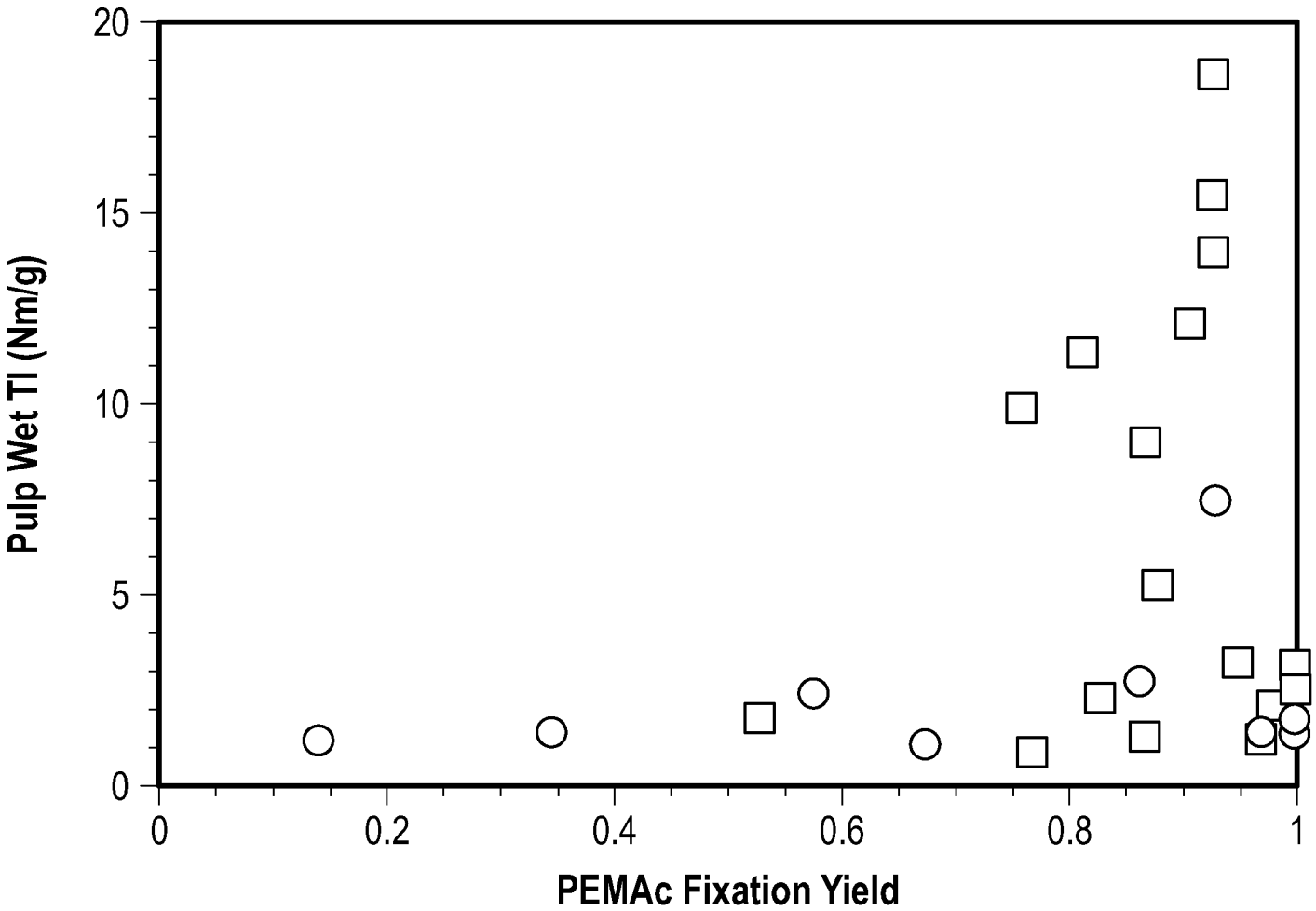

FIG. 9 shows the wet strength of cured pulp sheets treated at pH 4 as functions of the corresponding fixation yield. The scattered points in FIG. 9 do not reflect noise or experimental error but instead result from using a range of curing times 18, curing temperatures 16, PEMAc dosages, and PEMAc molecular weights. As noted above, the circular shaped data points are for the L-PEMAc, and the square shaped data points are for the H-PEMAc. The ideal result is no wet strength and a fixation yield of 1 (the lower right-hand corner of FIG. 9). Pulp sheets with WTIs below about 2 Nm/g were easily repulpable in a standard laboratory disintegrator whereas those reaching 3 Nm/g required more aggressive redispersion. For the high molecular weight H-PEMAc, all but one of the fixation yields are high. The major challenge with H-PEMA was maintaining low WTI and thus repulpability. By contrast, with L-PEMAc, the WTIs were low, however, many of the fixation yields were too low. Focusing on yields greater than 0.8 and WTIs <3 Nm/g we see it is possible to obtain high yields and low wet strengths. However, the data portrayal in FIG. 9 says nothing about the amounts of added polymer, the curing temperatures 16, or the curing times 18.

The experimental results in FIG. 9 reveal curing conditions do exist yielding both high fixation yields and low WTIs (i.e., good repulpability). However, there are many adjustable parameters in our treatment studies including the molecular weight of the polymer, the amount of polymer applied to the untreated substrate 10, the pH of the polymer ingredient 12 applied to the untreated substrate 10, curing time 18, and curing temperature 16. Not to be bound by theory, but one potential reason for the WTI to increase during the curing is the conversion of carboxylic acids of the succinic acid moiety converting to the corresponding succinic anhydrides. The extent of anhydride formation from the corresponding succinic acid moieties is defined herein as the dimensionless parameter beta, with a value ranging from 1 to 0. Beta is the fraction of succinic acid moieties that have been converted to succinic anhydride moieties, which may occur during curing. It is proposed that beta is a good single measure of the progress of curing during heating treated pulp.

In the absence of accurate measurements of beta in our cured pulp sheets, Equations 1 and 2, below, were used to estimate beta values corresponding to the various curing conditions. Succinic anhydride formation from succinic acid moieties is a unimolecular, first-order reaction. Therefore beta should depend upon curing time 18 and curing temperature 16 but should be independent of the mass fraction of PEMAc (or other polymer) in the pulp sheet. The rate expression for beta as a function of curing time 18, t, is given in Equation 1, where $k_r$ is the rate constant for anhydride formation. The temperature dependence of the rate constant is given by the Arrhenius expression, shown in Equation 2. To apply Equation 1, the pulp temperature may be determined as a function of curing time 18 so $k_r$ can be expressed as a function of time in Equation 1. In the absence of detailed temperature/time data during curing, we assumed isothermal curing and beta was evaluated by Eq. 3. Two other assumptions used were the reaction was irreversible and the rates of water transport out of the pulp were not rate determining. These two assumptions are reasonable because, in the experiments, the beta values were low (most far less than 0.2) and the polymer deposits on the substrate surfaces were thin.

$$\beta = 1 - \exp\left(-\int_0^t k_r t\right). \quad \text{Equation 1}$$

$$k_r = A \cdot \exp\left(\frac{-E_a}{RT}\right). \quad \text{Equation 2}$$

$$\beta = 1 - \exp(-k_r t). \quad \text{Equation 3}$$

For PEMAc films (no pulp present) dried from pH 4 solutions, the activation energy used was $E_a$=50 kJ/mol, and the pre-exponential factor was $A=1.24\times10^3\ s^1$. Published values for the activation energy of PEMA is 56 kJ/mole and for poly(vinyl methyl ether-alt-maleic anhydride) is 78.7 kJ/mole. Beta is a useful parameter to describe the extent of curing because it encompasses both the curing time 18 and curing temperature 16. However, in our experimental data, beta is an estimation of anhydride formation kinetics, as opposed to an actual measurement of the anhydride formation kinetics. It is anticipated that the wet tensile index of a PEMAc treated pulp sheet will increase with the product of the applied polymer content, the fixed gamma (measured in meq/g), the applied gamma, and the extent of curing, beta.

Figure 10:
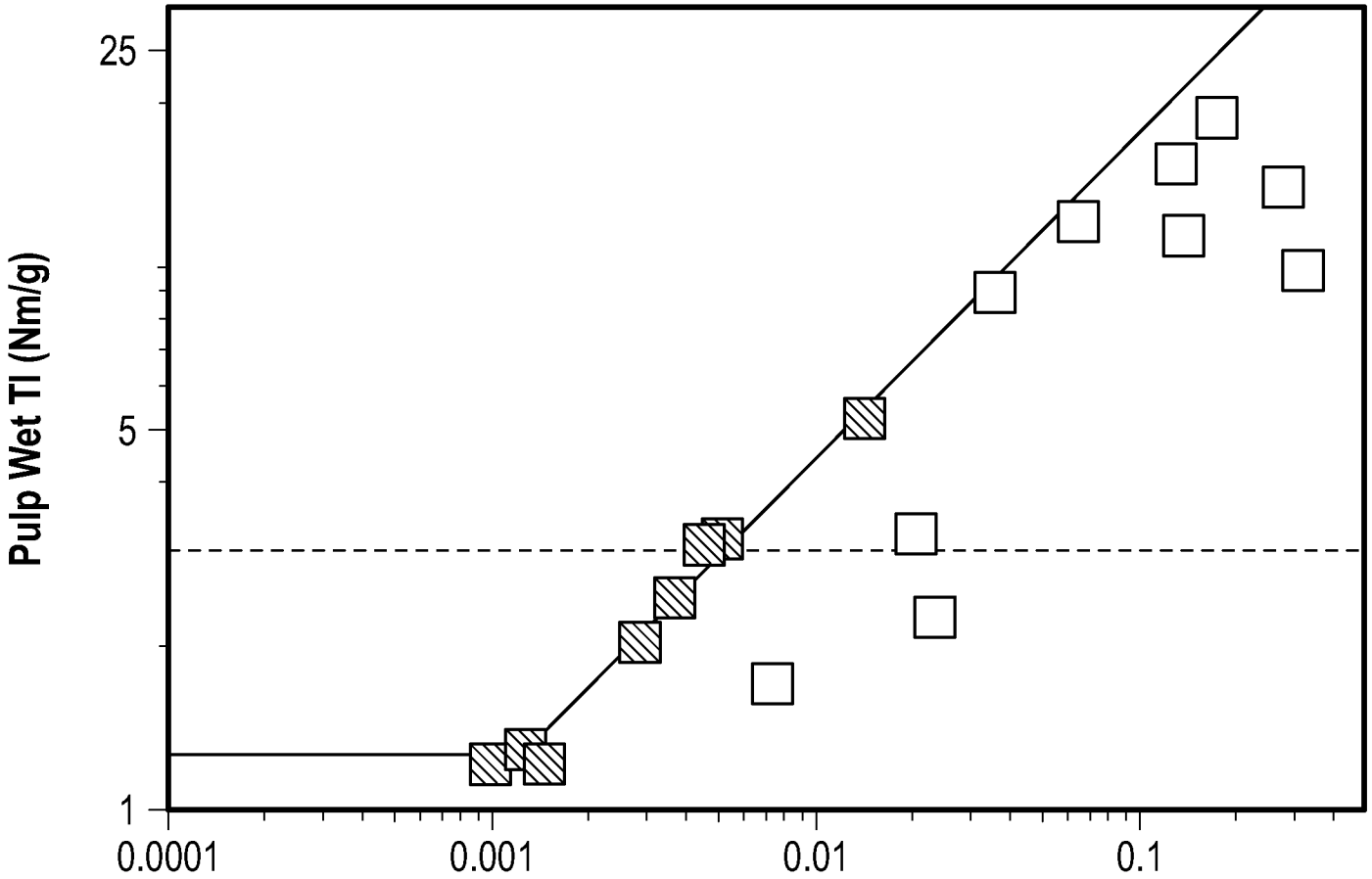

FIG. 10 is a log/log plot showing experimental H-PEMAc treated pulp wet tensile indices as functions of the beta gamma product. The applied gamma (Fa) values were determined based on the added polymer, as opposed to the fixed polymer, and the beta values were obtained by applying the experimental curing times 18 and curing temperatures 16 to Equation 3, shown above. The open boxes correspond to experiments with very high dosages of applied polymer, where the Fa was >0.4 meg/g or equivalently >25 kg of added PEMA per metric tonne of dry pulp. The closed boxes correspond to experiments where the $\Gamma_a$ value was less than or equal to 0.4 meg/g. The dashed straight line fitted to the data points in FIG. 10 suggests a power-law relationship between the wet tensile index and the beta gamma product. The empirical fitted line was calculated by Equation 4, below, where WTI stands for wet tensile index, where b=0.6, and a=70 Nm/g. The horizontal line in FIG. 10 denotes where WTI=3 Nm/g. Most of the high dose results (i.e., the open boxes) fell below the power-law line. The power-law line in FIG. 10 fits the wet tensile indices versus the beta gamma product under conditions where the fixation yield is very high and where $\Gamma$<0.4 meq/g. FIG. 10 yields $\beta\Gamma_{a3=0.052}$ meq/g corresponding to a wet tensile index of 3 Nm/g, corresponding to the intersection point of the 3 Nm/g horizontal line with the power-law curve. This $\beta\Gamma_{a3}$ value can be used as design tool for choosing curing conditions in larger scales treatment scenarios. The corresponding $\beta\Gamma_{a2}$ value is 0.0027 meq/g reflecting a more conservative design target, where $\beta\Gamma_{a2}$ represents the $\beta\Gamma_a$ value corresponding to a wet tensile index of 2 Nm/g.

$$WTI = a \cdot \frac{\beta\Gamma}{\text{meq}/g}^{\,b}. \quad \text{Equation 4}$$

Figure 11:
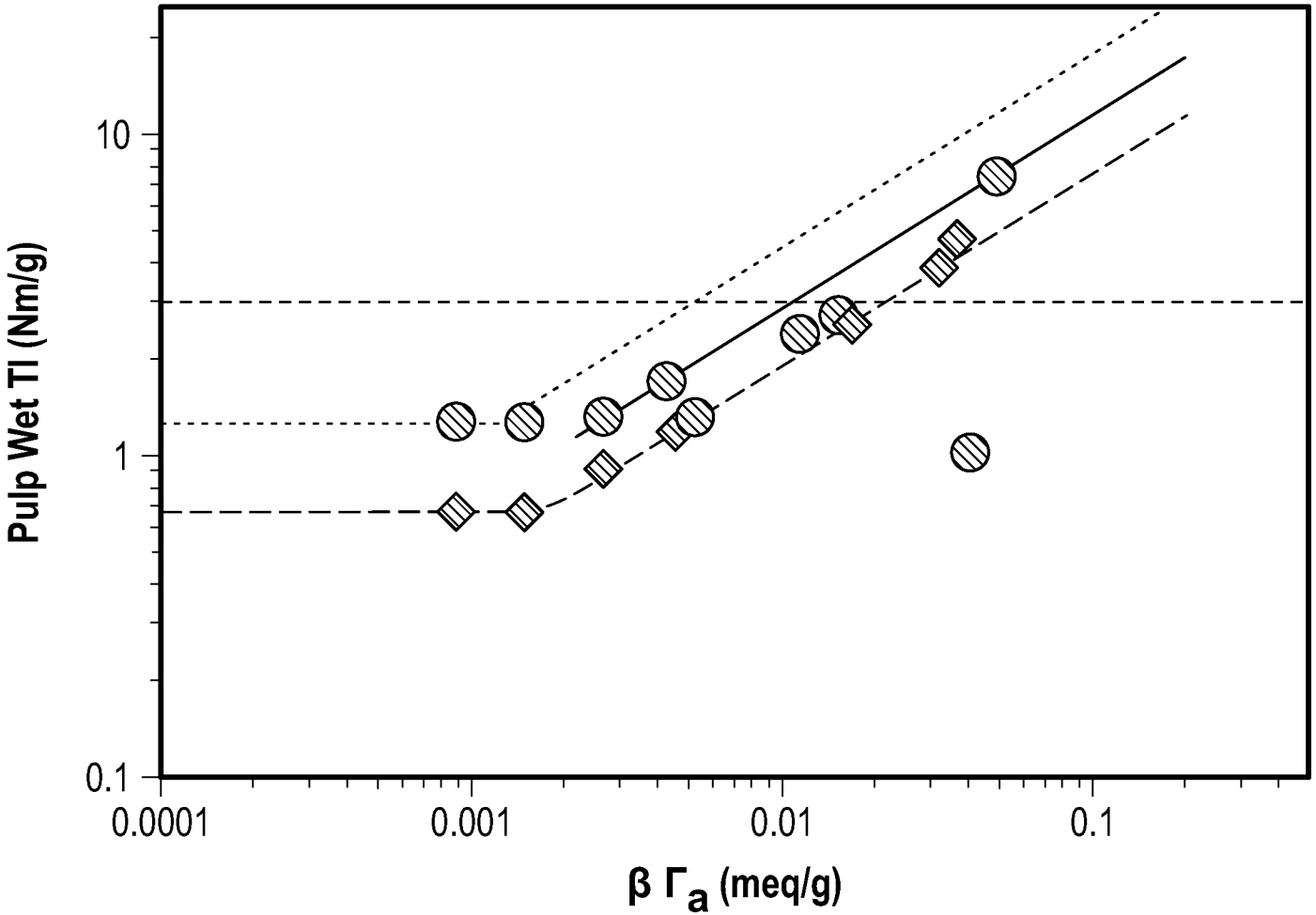

Reference is made to FIG. 11 that compares wet tensile index versus $\beta\Gamma_a$ for three cases: a strong pulp with high molecular polymer (dashed line closed to Y-axis, bleached softwood pulp+H-PEMA), a strong pulp with a lower molecular weight polymer (circles, bleached softwood pulp+L-PEMA), and a weaker pulp with a high molecular weight polymer (diamonds, bleached hardwood pulp+H-PEMA). All three combinations display power-law behaviors, each with a slope of 0.6. However, the weaker combinations are shifted to right, giving higher $\beta\Gamma_{a2}$ and $\beta\Gamma_{a3}$ values. It is recommended that laboratory handsheet studies be conducted to generate figures corresponding to FIGS. 10 and 11 for each new combination of polymer and substrate, so $\beta\Gamma_{a2}$ and/or $\beta\Gamma_{a3}$ values can be determined for the specific polymer and substrate combination. The table below summarizes these values for FIG. 11.

TABLE 1

| Polymer | Pulp | a (Nm/g) | b | $\beta\Gamma_2$ (meq/g) | $\beta\Gamma_3$ (meq/g) |
|---|---|---|---|---|---|
| H-PEMAc | Softwood | 70 | 0.6 | 0.0027 | 0.0052 |
| L-PEMAc | Softwood | 45 | 0.6 | 0.0056 | 0.011 |
| H-PEMAc | Hardwood | 30 | 0.6 | 0.011 | 0.022 |

The power-law coefficients for Eq. 4 and the corresponding repulpability limits $\beta\Gamma_{a2}$ giving wet tensile index=2 Nm/g and $\beta\Gamma_{a3}$ for 3 Nm/g extracted from the power-law lines plotted in FIG. 11.

While the present disclosure has been described with respect to particular embodiments thereof, it is apparent that numerous other forms and modifications will be obvious to those skilled in the art. The processes and products described in this application generally should be construed to cover all such obvious forms and modifications, which are within the true scope of the present disclosure.

What is claimed is:

1. A treated substrate comprising:

lignocellulose;

one or more polymers fixed to the lignocellulose to form the treated substrate, wherein the one or more polymers comprises a succinic moiety that can reversibly change between a succinic anhydride moiety and a succinic acid moiety, wherein the treated substrate has a wet tensile index of about 3 newton meters per gram or less, and wherein the one or more polymers comprises a copolymer of maleic anhydride, maleic acid, or combinations thereof with a monomer selected from the group consisting of acrylamidomethylpropane sulfonic acid, diallyldimethylammonium salt, acryloylethyltrimethyl ammonium salt, acryloylethyl dimethylamine, ethacryloylethyltrimethyl ammonium salt, ethacryloylethyl dimethylamine, methacryloylethyl trimethyl ammonium salt, methacryloylethyl dimethylamine, acrylamidopropyltrimethyl ammonium salt, acrylamidopropyl dimethylamine, methacrylamidopropyl trimethyl ammonium salt, methacrylamidopropyl dimethylamine, vinylformamide, vinylamine, acrylamide, methacrylamide, N-alkylacrylamide, vinylformamide, methyl vinyl ether, octadecene, isobutylene, butadiene, ethylene, and mixtures thereof: thereof, and where the one or more polymers comprises poly (butadiene-co-maleic acid).

2. The treated substrate of claim 1, wherein:

the one or more polymers fixed to the lignocellulose consists of the one or more polymers comprising the succinic moiety that can reversibly change between the succinic anhydride moiety and the succinic acid moiety.

3. The treated substrate of claim 1, wherein:

a fixed gamma ($\Gamma_f$) value represents an amount of the polymer fixed to the treated substrate measured in milliequivalents of a titratable carboxyl group of the polymer per gram of dry treated substrate, and wherein the $\Gamma_f$ value is at least about 0.001 milliequivalents per gram of the dry treated substrate.

4. The treated substrate of claim 1, wherein:

the treated substrate primarily comprises wood pulp.

5. The treated substrate of claim 1, wherein:

the treated substrate comprises kraft pulp.

6. The treated substrate of claim 1, wherein the one or more polymers consist of poly (butadiene-co-maleic acid).

7. The treated substrate of claim 1, wherein the polymer has a weight average molecular weight of from about 2 to about 10,000 kilodaltons.

8. The treated substrate of claim 1, wherein the wet tensile index of the treated substrate is about 2 newton meters per gram or less.

9. A treated substrate comprising:

lignocellulose;

a polymer fixed to the lignocellulose to form the treated substrate, wherein the polymer consists of the polymer that comprises a succinic moiety that can reversibly change between a succinic anhydride moiety and a succinic acid moiety, wherein the treated substrate has wet tensile index of about 3 newton meters per gram or less, wherein the treated substrate has a fixed gamma value, wherein the fixed gamma value represents an amount of polymer fixed to the treated substrate measured in milliequivalents of a titratable carboxyl group of the polymer per gram of dry treated substrate, and wherein the fixed gamma value is about 0.001 milliequivalents per gram of dry treated substrate or greater.

10. A method of forming a treated substrate, the method comprising the steps of:

applying a polymer ingredient to an untreated substrate to form a polymer substrate combination, wherein the untreated substrate comprises lignocellulose, the polymer ingredient comprises a one or more polymers, wherein the one or more polymers comprises a succinic moiety that can reversibly change between a succinic anhydride moiety and a succinic acid moiety, and wherein the one or more polymers comprises a copolymer of maleic anhydride, maleic acid, or combinations thereof with a monomer selected from the group of consisting of acrylamidomethylpropane sulfonic acid, diallyldimethylammonium salt, acryloylethyltrimethyl ammonium salt, acryloylethyl dimethylamine, ethacryloylethyltrimethyl ammonium salt, ethacryloylethyl dimethylamine, methacryloylethyl trimethyl ammonium salt, methacryloylethyl dimethylamine, acrylamidopropyltrimethyl ammonium salt, acrylamidopropyl dimethylamine, methacrylamidopropyl trimethyl ammonium salt, methacrylamidopropyl dimethylamine, vinylformamide, vinylamine, acrylamide, methacrylamide, N-alkylacrylamide, vinylformamide, methyl vinyl ether, octadecene, isobutylene, butadiene, ethylene, and mixtures thereof, and wherein the one or more polymers comprise poly (butadiene-co-maleic acid);

fixing the one or more polymers to the untreated substrate to form the treated substrate by heating the polymer substrate combination to a curing temperature of about 100 degrees Celsius or greater for a curing time; and terminating the heating of the polymer substrate combination when a wet tensile index of the treated substrate is about 3 newton meters per gram or less, and when a fixed gamma ($\Gamma_f$) value of the treated substrate is about 0.001 milliequivalents per gram of dry treated substrate or greater, wherein the $\Gamma_f$ value represents an amount of polymer fixed to the treated substrate measured in milliequivalents of titratable carboxyl groups of the polymer per gram of dry treated substrate.

11. The method of claim 10, further comprising:

adjusting a pH of the polymer substrate combination to from about 2 to about 5.

12. The method of claim 10, further comprising:

adjusting a pH of the polymer substrate combination to from about 3 to about 4.5.

13. The method of claim 10, wherein:

fixing the one or more polymers to the untreated substrate comprises fixing the one or more polymers to the untreated substrate to produce the $\Gamma_f$ value of about 0.03 to 10 milliequivalents per dry gram of the treated substrate.

14. The method of claim 10, wherein:

fixing the one or more polymers to the untreated substrate comprises heating the polymer ingredient and the untreated substrate to the curing temperature, wherein the curing temperature is about 150 degrees Celsius or greater.

15. The method of claim 10, wherein:

terminating the heating of the treated substrate when a beta gamma product of the treated substrate ($\beta\Gamma_a$) is less than or equal to a beta gamma product corresponding to the wet tensile index of 3 newton meters per gram of the treated substrate ($\beta\Gamma_{a3}$), where beta ($\beta$) is a total succinic anhydride moiety of the polymer divided by a total succinic moiety of the polymer, and an applied gamma ($\Gamma_a$) of the treated substrate is the amount of polymer added to the untreated substrate in milliequivalents per gram of dry treated substrate.

16. The method of claim 10, wherein:

the polymer has a weight average molecular weight of from about 2 to about 10,000 kilodaltons.

17. The method of claim 10, wherein:

The polymer ingredient is free of alkali metal hypophosphites and phosphites, (i.e., $MH_2PO_2$, $MH_2PO_3$ and $M_2HPO_3$), where M is the alkali metal; an alkali metal salt of polyphosphoric acid; lithium dihydrogen phosphate; sodium dihydrogen phosphate; potassium dihydrogen phosphate; sodium hypophosphite; sodium salt of dichloroacetic acid; p-toluenesulfonic acid; 1,4-dimethylaminopyridin; 1-methylimidazole; and combinations thereof.

18. The method of claim 10, wherein:

terminating the heating comprises producing the treated substrate wherein the wet tensile index of the treated substrate is about 2 newton meters per gram or less.

* * * * *